US010126678B2

(12) United States Patent
Hashida et al.

(10) Patent No.: US 10,126,678 B2
(45) Date of Patent: Nov. 13, 2018

(54) TONER, TONER HOUSING UNIT, IMAGE FORMING APPARATUS, AND IMAGE FORMING METHOD

(71) Applicants: Shizuka Hashida, Shizuoka (JP); Hiroshi Yamashita, Shizuoka (JP); Minoru Masuda, Shizuoka (JP); Hiroshi Yamada, Shizuoka (JP); Masanori Rimoto, Shizuoka (JP)

(72) Inventors: Shizuka Hashida, Shizuoka (JP); Hiroshi Yamashita, Shizuoka (JP); Minoru Masuda, Shizuoka (JP); Hiroshi Yamada, Shizuoka (JP); Masanori Rimoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/277,456

(22) Filed: Sep. 27, 2016

(65) Prior Publication Data

US 2017/0108791 A1 Apr. 20, 2017

(30) Foreign Application Priority Data

Oct. 20, 2015 (JP) ..... 2015-206394
Jun. 13, 2016 (JP) ..... 2016-117449

(51) Int. Cl.
*G03G 9/097* (2006.01)
*G03G 15/08* (2006.01)
*G03G 9/08* (2006.01)

(52) U.S. Cl.
CPC ..... *G03G 15/08* (2013.01); *G03G 9/0825* (2013.01); *G03G 9/09783* (2013.01)

(58) Field of Classification Search
CPC ..... G03G 9/09716; G03G 9/09783; G03G 9/0975
See application file for complete search history.

(56) References Cited

U.S. PATENT DOCUMENTS 4,900,647 A * 2/1990 Hikake ..... G03G 9/0802 264/15
6,632,579 B1 10/2003 Yamashita
2001/0010887 A1* 8/2001 Sawano ..... C07F 7/006 430/108.3
2006/0177756 A1 8/2006 Sugimoto et al.
(Continued)

FOREIGN PATENT DOCUMENTS

JP 11-190915 7/1999
JP 2002-148859 5/2002
(Continued)

OTHER PUBLICATIONS

Diamond, "Handbook fo Imaging Materials," Marcel Dekker, NY, NY, 1991. pp. 380-382.*
Translation of JP 2008-039896 published Feb. 2008.*

*Primary Examiner* — Peter L Vajda
(74) *Attorney, Agent, or Firm* — Oblon, McClelland, Maier & Neustadt, L.L.P.

(57) ABSTRACT

A toner includes a binder resin. Particles of a metal complex or a salt of an aromatic carboxylic acid derivative having a number-average particle diameter of from 0.2 μm to 1.0 μm are present on the surface of the toner. A coverage of the particles of a metal complex or a salt of an aromatic carboxylic acid derivative over the surface of the toner is from 10% to 50%.

23 Claims, 3 Drawing Sheets

(56) References Cited

U.S. PATENT DOCUMENTS

| | | | | |
|---|---|---|---|---|
| 2013/0337376 | A1 | 12/2013 | Watanabe et al. | |
| 2014/0120467 | A1* | 5/2014 | Sweeney | G03G 9/09708 430/108.24 |
| 2014/0147778 | A1* | 5/2014 | Murakami | G03G 9/08755 430/105 |

FOREIGN PATENT DOCUMENTS

| | | | | |
|---|---|---|---|---|
| JP | 2002-357929 | | 12/2002 | |
| JP | 2006-208609 | | 8/2006 | |
| JP | 2008-039896 | * | 2/2008 | G03G 9/087 |
| JP | 2009-053696 | | 3/2009 | |
| JP | 2011-123483 | | 6/2011 | |
| JP | 2011-150229 | | 8/2011 | |

* cited by examiner

TONER, TONER HOUSING UNIT, IMAGE FORMING APPARATUS, AND IMAGE FORMING METHOD

CROSS-REFERENCE TO RELATED APPLICATIONS

This patent application is based on and claims priority pursuant to 35 U.S.C. § 119 to Japanese Patent Applications Nos. 2015-206394 and 2016-117449, filed on Oct. 20, 2015, and Jun. 13, 2016 in the Japan Patent Office, the entire disclosure of which is hereby incorporated by reference herein.

BACKGROUND

Technical Field

The present invention relates to a toner, a toner housing unit, an image forming apparatus and an image forming method using the toner.

Description of the Related Art

Technologies to fix a toner at low energy are desired because environment-oriented products have grown in prosperity in recent years. There are various means therefor, and particularly, a toner for forming an electrostatic latent image, which is fixable at lower temperature is strongly demanded.

As a means for lowering the fixable temperature of a toner, a glass transition temperature (Tg) of the toner binder is typically lowered. However, when the Tg is simply lowered, powders may aggregate (aggregation of a powder is called "blocking" in the present invention) in image forming apparatuses, resulting in inability of operation of the image developer. If not inability of operation thereof, the powder may aggregate in a toner housing unit and the toner cannot be fed and lowers in density, resulting in production of abnormal images.

When many images are continuously produced by a printer, the images may adhere to each other just after produced because they are not cooled enough after heated to fix the images (this is called "ejected paper blocking" in the present disclosure). Therefore, the toner need to have better anti-blocking properties of ejected papers. Further, when Tg is lowered, the toner on the surface of a fixed image has worse preservability. The fixed image which easily melts and transfers adheres to other recording medium when the ejected papers are stored at high temperature with a pressure, they may not be stored for long periods.

Simply lowering Tg can hardly obtain a toner having good image preservability and low-temperature fixability without the "blocking" and "blocking of ejected papers".

SUMMARY

A toner includes a binder resin. Particles of a metal complex or a salt of an aromatic carboxylic acid derivative having a number-average particle diameter of from 0.2 μm to 1.0 μm are present on the surface of the toner. A coverage of the particles of a metal complex or a salt of an aromatic carboxylic acid derivative over the surface of the toner is from 10% to 50%.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
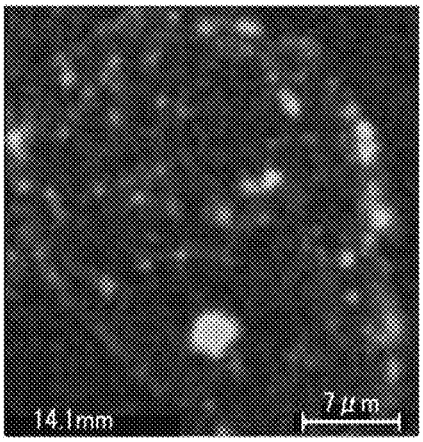
FIG. 1 is a schematic view for explaining an EDS image of Zr of an embodiment of the toner of the present invention.

Accordingly, one object of the present invention is to provide a toner having low-temperature fixability, anti-blocking of ejected papers and image preservability.

Another object of the present invention is to provide a toner housing unit using the toner.

A further object of the present invention is to provide an image forming apparatus using the toner.

Another object of the present invention is to provide an image forming method using the toner.

(Toner)

The toner of embodiments of the present invention includes at least a binder resin.

Particles of a metal complex or a salt of an aromatic carboxylic acid derivative crosslinkable with heat energy are present on the surface of the toner.

The particles of a metal complex or a salt of an aromatic carboxylic acid derivative have a number-average particle diameter of from 0.2 μm to 1.0 μm. A coverage of the particles of a metal complex or a salt of an aromatic carboxylic acid derivative over the surface of the toner is from 10% to 50%.

The toner further include other components such as a release agent and a colorant when necessary.

The low-temperature fixability, anti-blocking of ejected papers and image preservation have trade-off relations. In order to avoid the trade-off, a crosslinker which is not reactable until placed under high temperature when fixing images is thought to locate on the surface of the toner without modifying the structure of the resin. As the crosslinker, a salt or a complex having a multivalent metal capable of ion or coordinate bonding with an acid terminal or a hydroxyl terminal of polyester which is a binder resin is thought. For example, a metal salt or a metal complex of a salicylic acid derivative can be used. This has charge controllability as well, and Japanese Patent No. JP-3631468-B2 discloses the metal salt or complex of a salicylic acid derivative externally added to a toner as a charge controlling agent, and Japanese Patent No. JP-3945797-B2 discloses the metal salt or complex of a salicylic acid derivative adhering to the surface of a toner in water. However, these are for improving chargeability, and the locations and particle sizes of the salicylic acid derivative disclosed therein do not satisfy the low-temperature fixability, anti-blocking of ejected papers and image preservation.

On the surface of the toner of the present invention, a crosslinking reaction is performed to harden the surface layer, and the low-temperature fixable toner prevents the anti-blocking of ejected papers and has good image preservation.

On the surface of the toner of the present invention, through the particles of a metal complex or a salt of an aromatic carboxylic acid derivative as a resin crosslinker, a crosslinking reaction among the binder resins is performed with heat energy when fixing. For example, hydrogen bonding, covalent bonding, ionic bonding, coordinate bonding can be used to evoke an interaction between polymers of the resins. The ionic bonding and the coordinate bonding are preferably used because of being performable at low temperature. As a result, polymeric components are generated and the toner has a larger molecular weight after heated.

In the present invention, the ionic bonding or the coordinate bonding by heating the metal complex or a salt of an aromatic carboxylic acid derivative and a polar group of the binder resin is used to generate the interaction between polymers on the surface of the toner even when heated at extremely low temperature at 100° C. for preventing blocking of ejected papers.

<Metal Complex or Salt of Aromatic Carboxylic Acid Derivative>

The particles of the metal complex or the salt of the aromatic carboxylic acid derivative has a number-average particle diameter of from 0.2 μm to 1.0 μm, and preferably from 0.2 μm to 0.5 μm.

The metal complex or the salt of the aromatic carboxylic acid derivative needs to have a large contact area with the binder resin to efficiently react therewith. When the number-average particle diameter is larger than 1.0 μm, an areal ratio of the metal complex or the salt of the aromatic carboxylic acid derivative contacting the surface of the toner relative to the content thereof is small, resulting in low crosslinking effect.

A coverage of the particles of the metal complex or the salt of the aromatic carboxylic acid derivative over the surface of the toner is from 10% to 50%, and preferably from 10% to 40%.

When less than 10%, the reaction points are too few to dully harden the surface, resulting in insufficient anti-blocking of ejected papers. When larger than 50%, the metal complex or the salt of the aromatic carboxylic acid derivative works as a fixation inhibiting factor, resulting in deterioration of low-temperature fixability.

The metal complex or the salt of the aromatic carboxylic acid derivative needs to effectively react with the binder resin when heated at low temperature. It is important that the metal complex or the salt of the aromatic carboxylic acid derivative disperses and adheres on the surface of the toner in the shape of fine particles. Thereby, as mentioned later in the method of preparing the toner, a process of making the metal complex or the salt of the aromatic carboxylic acid derivative adhere on the surface of the toner is effectively provided. In addition, the metal complex or the salt of the aromatic carboxylic acid derivative is effectively heated in such a range of temperature as not to cause crosslinking reaction to strengthen adhesion.

To prevent blocking of ejected papers and improve image preservation, hardness of the toner in the surface layer of the fixed image is important. The metal complex or the salt of the aromatic carboxylic acid derivative as a crosslinker present only on the surface of the toner exerts an effect of anti-blocking of ejected papers as well as when included in the toner as well even in an amount less than when included therein. Therefore, increase of the fixable temperature due to the metal complex or the salt of the aromatic carboxylic acid derivative can be minimized.

The toner preferably includes the metal complex or the salt of the aromatic carboxylic acid derivative in an amount of from 0.4% to 6% by mass. When the toner is a polymerization toner having a typical particle diameter of from 5.5 μm to 7 μm, and the metal complex or the salt of the aromatic carboxylic acid derivative has a particle diameter of from 0.4 μm to 0.5 μm, which is easy to prepare, the coverage is less than 10% when the toner includes the metal complex or the salt of the aromatic carboxylic acid derivative in an amount less than 0.4% by mass. Therefore, when less than 0.4% by mass, crosslinking points are few, and the molecular weight of the binder resin at the surface of the toner cannot effectively be increased. When greater than 6% by mass, the coverage is not less than 50%. Therefore, the metal complex or the salt of the aromatic carboxylic acid derivative on the surface of the toner impairs fixability of the toner when greater than 6% by mass.

Examples of the metal complex or the salt of the aromatic carboxylic acid derivative include a metal complex or a salt of a salicylic acid derivative or a hydroxy naphthoic acid derivative having the following formula:

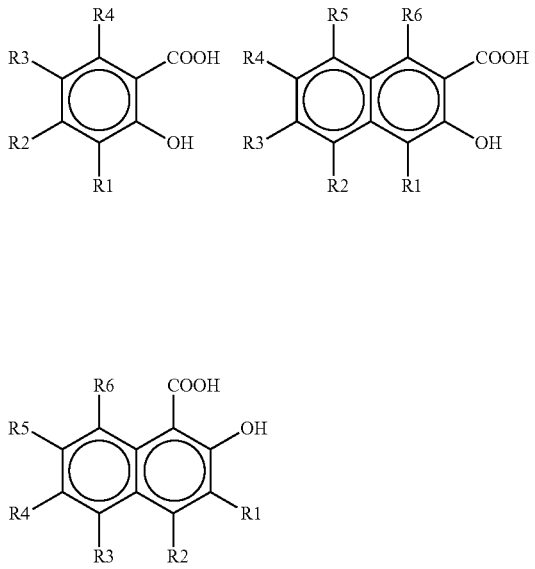

wherein $R_1$ to $R_6$ independently represent a hydrogen atom, a branchable alkyl group having 1 to 12 carbon atoms, a branchable alkenyl group having 2 to 12 carbon atoms, —OH, —$NH_2$, —$NH(CH_3)$, —$N(CH_3)_2$, —$OCH_3$, —$OC_2H_5$, —COOH or —$CONH_2$.

Among them, the metal complex or the salt of the salicylic acid derivative is preferably used, and a metal complex or a salt of a ditertiary butyl salicylic acid derivative is more preferably used.

A metal forming the metal complex or the salt is preferably $Zn^{2+}$, $Al^{3+}$, $Cr^{3+}$, $Fe^{3+}$ or $Zr^{4+}$, tri- or more valent metals are more preferably used, and $Zr^{4+}$ is furthermore preferably used.

In order to quickly proceed crosslinking reaction when fixing, the metal complex or the salt of the aromatic carboxylic acid derivative is preferably present on the surface of the toner finely and uniformly. The smaller the particle diameter and the molecular weight of the metal complex or the salt of the aromatic carboxylic acid derivative, the higher the coverage even with a small amount thereof, which is advantageous for the toner to fix at low temperature.

Particularly, a zirconium compound having the following formula (2) is preferably used:

(2)

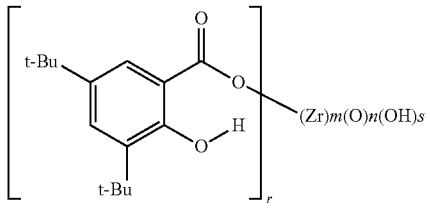

wherein m represents an integer of from 1 to 20; n represents 0 or an integer of from 1 to 20; s represents 0 or an integer of from 1 to 20; r represents an integer of from 1 to 20; and t-Bu represents a tertiary butyl group.

<<Method of Verifying Presence of Metal Complex or Salt of Aromatic Carboxylic Acid Derivative>>

In the present invention, as a method of verifying the metal complex or the salt of the aromatic carboxylic acid derivative is present on the surface of the toner not therein, combination of measuring abundance of elements on the surface of the toner and measuring abundance of elements of the entire toner is thought.

As a method of measuring abundance of elements on the surface of the toner, X-ray photoelectron spectroscopy (XPS) capable of detecting the depth of about 5 nm from the surface can be used.

As a method of measuring abundance of elements of the entire toner, X-ray fluorometry (XRF) can be used.

The result of XPS is standardized by the result of XRF to form an index of the abundance of elements on the surface of the toner to the abundance of elements of the entire toner.

<<<Measurement of Metal Abundance on Surface>>>

K-Alpha from Thermo-Fisher Scientific K.K. is used for the XPS measurement. A1 (monochrome meter) is used as a measurement light source and a toner is dispersed in an analysis scope of 400 $\mu m^2$.

An atomic % is measured under the following conditions.

Pass energy: (wide scan) 200 eV (Narrow scan) 50 ev

Energy step: (wide scan) 1.5 eV (Narrow scan) 0.2 eV

Relative sensitivity factor: Thermo-Fisher's relative sensitivity factor

A metal compound can be analyzed by XPS to find the metal element is bonded with a binder resin or an oxygen atom from the aromatic carboxylic acid derivative.

<<<Measurement of Metal Abundance in All>>>

The XRF measurement is made by molding 3 g of a sample to a pellet having a diameter of 40 mm with a tablet molder at a pressure of 10 $t/cm^2$, and measuring with ZXS-100e from Rigaku Corp.

Regardless of the metal or the ligand, in order to define an amount of the metal complex or the salt of the aromatic carboxylic acid derivative, some pellets the contents of which are known are prepared with a compound including elements include in the metal complex or the salt of the aromatic carboxylic acid derivative to prepare a calibration curve.

A standard pellet is prepared as follows. First, a 2 liquid curing epoxy resin and a sample are weighed. The sample is fully kneaded and dispersed in the epoxy resin with a spatula, etc. A poly ring for forming a sample is placed on a poly bag, the sample is poured into the bag. After fully cured, the sample was removed from the bag to prepare a standard sample pellet.

The amount of the metal complex or the salt of the aromatic carboxylic acid derivative is defined by % by mass of the metal element conversion in the pellet.

<<<Measurement of Abundance on Surface>>>

The presence of the metal complex or the salt of the aromatic carboxylic acid derivative is defined as follows using the XPS and XRF measurements.

A ratio (M/T) of a content measured by XPS of one element M (atomic %) present on the surface of the toner within the fifth period in a long-period periodic table except for hydrogen, carbon, oxygen and rare gas elements present only in the metal complex or the salt of the aromatic carboxylic acid derivative to a content measured by XRF of elements present in the entire toner (% by mass) is from 0.04 to 0.46.

<<<Measurement of Number-Average Particle Diameter • Coverage>>>

The toner coated with carbon for preventing charge-up is fixed on a carbon tape to observe with a scanning electron microscope (SEM) SU8230 from Hitachi, Ltd. and an energy dispersive X-ray analyzer (EDX) XFlash Flat QUAD 5060F from Bruker Corp. at accelerating voltage of 10 kV and magnification of 10,000 times. EDX images of metal elements used in the metal complex or the salt of the aromatic carboxylic acid derivative in not less than 10 toner particles are obtained.

The EDX images of metal elements are edited on an image edit software Azo kun from Asahi Kasei Engineering Corporation.

—Scale Setting—

From "Image Input and Output" tab, an image to be analyzed is read. Based on a scale bar in the image, a scale of the image is set with a "Scale Set" button.

—Image Processing—

From "Image Analysis" tab, "Color Image Process" is selected to covert a color image. An image having the most clear contrast is selected to convert into a monochrome image.

Then, from "Image Improvement" tab, "Laplacian Filter" process is selected to stress the edge of the image to reduced blurred image.

—Calculation of Number-Average Particle Diameter • Coverage—

[Image Process]

"Particle Analysis" is selected from "Image Analysis" tab.

Digitalization and correction are made by selecting "Manual", and "Enter" button is pushed to decide a small figure removal area so as not to remove particles having small particle diameters.

Comparing with the original image, a suitable threshold is decided to digitalize.

When there is a digitalized image in which the original plural particles are determined to be one particle, it is manually corrected while comparing with the original image, and "Finish" button is pushed.

The calculation result is obtained.

[Calculation of Each Parameter]

Number-average particle diameter: average perimeter is divided by the circular constant Coverage: (total area of the metal element particles)/(toner portion area)

Specifically, the metal particles area is determined by "a product of the average area and the number of particles" or "a product of measured region area and areal ratio".

Next, each of areas except for the toner is approximated with a triangle. Specifically, "Shape Measurement" is selected from "Image Analysis", and bases and heights of triangular portions around the toner are determined to obtain areas. The sum of the areas of the triangle is drawn from the "measured region area" to determine an area of the toner.

Finally, the metal particles area is divided by the toner area to determine a coverage.

Figure 2:
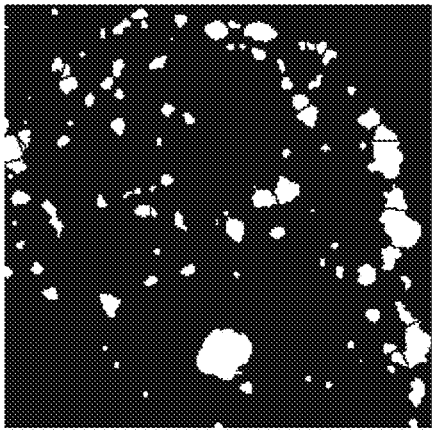
FIG. 2 is a schematic view for explaining an image after the EDS image of Zr of an embodiment of the toner of the present invention is digitalized.

FIG. 1 is a schematic view for explaining an EDS image of Zr of an embodiment of the toner of the present invention, and FIG. 2 is a schematic view for explaining an image after the EDS image of Zr is digitalized.

This is unable to separate a distribution of particles having a particle diameter not greater than 0.2 μm from a case where metal components uniformly cover the surface of the toner due to image resolution of the EDX image.

<<<Identification of Metal Complex or Salt of Aromatic Carboxylic Acid Derivative on Surface>>>

Five (5) g of the toner are wetted to 50 g of methanol, and after 1 g of 1% HCl is added thereto, it is subjected to ultrasonic for 10 min. A metal cation of the metal complex or the salt of the aromatic carboxylic acid derivative is converted into proton to elute.

An insoluble toner is filtered with a 5B filter paper, and filtrates are collected and a solvent is removed with an evaporator.

Five (5) mg of the precipitated white solid are transferred into a vial and is fully suspended in 1.2 g of dichloroform by supersonic oscillation. The solution is transferred into a NMR tube and $^1$H-NMR is measured to identify an aromatic carboxylic acid derivative.

<Toner Properties>

The toner preferably has an acid value of from 10 KOH/g to 50 mg KOH/g, and more preferably from 20 KOH/g to 40 mg KOH/g.

When not less than 10 mg KOH/g, reaction points with the metal complex or the salt of the aromatic carboxylic acid derivative are so many that the surface of the toner is fully cured. When not greater than 50 mg KOH/g, deterioration of low-temperature fixability due to too promoted reaction is effectively prevented.

When plural binder resins are used, a resin, a resin having a low molecular weight and a low Tg is mixed as one component to improve low-temperature fixability. When the resin having a low molecular weight and a low Tg has a high acid value, crosslinking reaction is preferentially performed therewith and the resultant low-temperature fixable toner has higher anti-blocking effect of ejected papers.

It is important for the toner to include a hydroxyl group. The toner preferably has a hydroxyl value of from 5 KOH/g to 40 mg KOH/g, and more preferably from 10 KOH/g to 30 mg KOH/g.

<<Measurement of Acid Value of Toner>>

The acid value of the toner is measured by the following method. Basic operation is based on potentiometric titration disclosed in JIS K-0070.

(1) About 3 g of a sample is placed in a 200 mL beaker and weighed to mg unit. 100 mL of a tetrahydrofuran/acetone/methanol mixed liquid (volume ratio of 50/25/50) are added thereto to be dissolved.

(2) After the solution is heated for 20 min in a water bath at 60° C., undissolved components are subjected to ultrasonic oscillation for 5 min and uniformly dispersed in the solvent.

(3) After the solution is cooled to room temperature, a titration value to an inflection point is measured by potentiometric titrator COM2000 from HIRANUMA SANGYO Co., Ltd. with 0.1 mol/L KOH ethanol solution while stirred by a stirring bar.

(4) The acid value is determined by the following formula:

$$\text{Acid value (mg KOH/g)}=[S\times f\times 5.61]/W$$

Wherein S represents an amount (mL) used of KOH solution; f represents a factor of the 0.1 mol/L KOH ethanol solution; and W represents a weight (g) of the sample.

<Binder Resin>

The binder resin is preferably a resin having a carboxyl group. Particularly, a polyester resin having a carboxyl group at its terminal is preferably used.

In addition, a crystalline polyester resin and a polyester resin having a low glass transition temperature are effectively used for the toner to have low temperature fixability.

Preferred embodiments of the binder resin include a combination of an amorphous polyester resin, a polyester resin and a crystalline polyester resin.

<<Amorphous Polyester Resin>>

Details of constituents of an amorphous polyester resin are as follows.

—Diol—

Diols are not particularly limited if they include aliphatic diols in an amount not less than 50% by mol, and specific examples thereof include aliphatic diols such as ethylene glycol, 1,2-propylene glycol, 1,3-propylene glycol, 1,4-butanediol, and 1,6-hexanediol, 1, 8-octanediol, 1,10-decanediol and 1,12-dodecanediol; diols having an oxy alkylene group such as diethylene glycol, triethylene glycol, dipropylene glycol, polyethylene glycol, polypropylene glycol and polytetramethylene; alicyclic diol such as 1,4-cyclohexanedimethanol and hydrogenated bisphenol A; adducts of the above-mentioned alicyclic diol with an alkylene oxide such as ethylene oxide, propylene oxide and butylene oxide; bisphenols such as bisphenol A, bisphenol F and bisphenol S; and adducts of the above-mentioned bisphenol with an alkylene oxide such as ethylene oxide, propylene oxide and butylene oxide. In particular, aliphatic diols having 4 to 12 carbon atoms are preferably used. These diols can be used alone or in combination.

—Dicarboxylic Acid—

Specific examples of the dicarboxylic acid include, but are not limited to, aliphatic dicarboxylic acids and aromatic dicarboxylic acids. Their anhydrides, lower (having 1 to 3 carbon atoms) alkyl esterified compounds and halogenated compounds may be used.

Specific examples of the aliphatic dicarboxylic acid include, but are not limited to, succinic acid, adipic acid, sebacic acid, dodecanedioic acid, maleic acid and fumaric acid.

Specific examples of the aromatic dicarboxylic acid include, but are not limited to, phthalic acid, isophthalic acid, terephthalic acid, naphthalene dicarboxylic acid. Among these, aliphatic dicarboxylic acids having 4 to 12 carbon atoms are preferably used.

These dicarboxylic acids may be used alone or in combination.

—Tri- or Higher Valent Alcohol—

Specific examples of tri- or higher valent aliphatic alcohol include, but are not limited to, glycerin, trimethylolethane, trimethylolpropane, pentaerythritol, sorbitol and dipentaerythritol. Among these, tri- to tetravalent aliphatic alcohols are preferably used. These tri- or higher valent aliphatic alcohols can be used alone or in combination.

The amorphous polyester resin preferably has an acid value not less than 10 mg KOH/g, and more preferably not less than 20 mg KOH/Wg for the resultant toner to have desired low-temperature fixability in terms of affinity between papers and resins. Meanwhile, the amorphous polyester resin preferably has an acid value not greater than 50 mg KOH/g for the resultant toner to improve hot offset resistance.

The amorphous polyester resin preferably has a hydroxyl value of from 5 KOH/Wg to 40 mg KOH/g, and more preferably from 10 to 30 mg KOH/g for the resultant toner to have desired low-temperature fixability and good blocking resistance.

A polyester resin including a urethane bond and a urea bond is used to control viscoelasticity with hydrogen bonding strength.

<<<Polyester Resin Including Urethane Bond and Urea Bond>>>

The polyester resin including a urethane bond and a urea bond is obtained through a reaction between a nonlinear reactive precursor and a curing agent. The polyester resin including a urethane bond and a urea bond preferably has a glass transition temperature of from −60° C. to 0° C. for the toner to have desired low-temperature fixability, —Nonlinear Reactive Precursor—

The nonlinear reactive precursor is not particularly limited if it is a polyester resin having a group reactable with the curing agent (hereinafter referred to as "prepolymer"), and can be selected according to purposes.

The group reactable with the curing agent includes a group reactable with an active hydrogen group, etc. The group reactable with an active hydrogen group includes an isocyanate group, an epoxy group, a carboxylic acid, an acid chloride group, etc. Among these, the isocyanate group is preferably used because of being capable of introducing a urethane bond or a urea bond to the amorphous polyester resin.

The prepolymer is nonlinear. Nonlinear means having a branched structure imparted by at least one of tri- or higher valent alcohol or tri- or higher valent carboxylic acid.

The prepolymer is preferably a polyester resin including an isocyanate group.

——Polyester Resin Including Isocyanate Group——

The polyester resin including an isocyanate group is not particularly limited and can be selected according to purposes, and includes a reaction product between a polyester resin having an active hydrogen group and polyisocyanate, etc. The polyester resin having an active hydrogen group is obtained by polycondensing a diol, a dicarboxylic acid, and tri- or higher valent alcohol or tri- or higher valent carboxylic acid. The tri- or higher valent alcohol and the tri- or higher valent carboxylic acid impart a branched stricture to the polyester resin having a isocyanate group.

———Diol———

Specific examples of the diols include, but are not limited to, aliphatic diols such as ethylene glycol, 1,2-propylene glycol, 1,3-propylene glycol, 1,4-butanediol, and 1,6-hexanediol, 1,8-octanediol, 1,10-decanediol and 1,12-dodecanediol; diols having an oxy alkylene group such as diethylene glycol, triethylene glycol, dipropylene glycol, polyethylene glycol, polypropylene glycol and polytetramethylene; alicyclic diol such as 1,4-cyclohexanedimethanol and hydrogenated bisphenol A; adducts of the above-mentioned alicyclic diol with an alkylene oxide such as ethylene oxide, propylene oxide and butylene oxide; bisphenols such as bisphenol A, bisphenol F and bisphenol S; and adducts of the above-mentioned bisphenol with an alkylene oxide such as ethylene oxide, propylene oxide and butylene oxide. In particular, aliphatic diols having 4 to 12 carbon atoms are preferably used. These diols can be used alone or in combination.

——Dicarboxylic Acid——

Specific examples of the dicarboxylic acid include, but are not limited to, aliphatic dicarboxylic acids and aromatic dicarboxylic acids. Their anhydrides, lower (having 1 to 3 carbon atoms) alkyl esterified compounds and halogenated compounds may be used.

Specific examples of the aliphatic dicarboxylic acid include, but are not limited to, succinic acid, adipic acid, sebacic acid, dodecanedioic acid, maleic acid and fumaric acid.

Specific examples of the aromatic dicarboxylic acid include, but are not limited to, phthalic acid, isophthalic acid, terephthalic acid, naphthalene dicarboxylic acid.

Among these, aliphatic dicarboxylic acids having 4 to 12 carbon atoms are preferably used.

These dicarboxylic acids may be used alone or in combination.

———Tri- or Higher Valent Alcohol———

The tri- or higher valent alcohol includes, e.g., tri- or higher valent aliphatic alcohol, tri- or higher valent polyphenol and adducts of the tri- or higher valent polyphenol with an alkylene oxide. Specific examples of the tri- or higher valent aliphatic alcohol include, but are not limited to, glycerin, trimethylolethane, trimethylolpropane, pentaerythritol and sorbitol.

Specific examples of the tri- or higher valent polyphenol include, but are not limited to, trisphenol PA, phenolnovolak and cresolnovolak.

Specific examples of the adducts of the tri- or higher valent polyphenol with an alkylene oxide include, but are not limited to, adducts of the tri- or higher valent polyphenol with an alkylene oxide such as ethylene oxide, propylene oxide and butylene oxide.

———Tri- or Higher Valent Carboxylic Acid———

Specific examples of the tri- or higher valent carboxylic acid include, but are not limited to, tri- or higher valent aromatic carboxylic acids. Their anhydrides, lower (having 1 to 3 carbon atoms) alkyl esterified compounds and halogenated compounds may be used.

The tri- or higher valent aromatic carboxylic acids are preferably tri- or higher valent aromatic carboxylic acids having 9 to 20 carbon atoms. Specific examples thereof include, but are not limited to, trimellitic acid and pyromellitic acid.

—Polyisocyanate—

Specific examples of the polyisocyanate include, but are not limited to, diisocyanate and tri- or higher valent isocyanate.

Specific examples of the diisocyanate include, but are not limited to, aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

Specific examples of the aliphatic diisocyanate include, but are not limited to, tetramethylene diisocyanate, hexamethylene diisocyanate, 2,6-diisocyanato methyl caproate, octamethylene diisocyanate, decamethylene diisocyanate, dodecamethylene diisocyanate, tetra decamethylene diisocyanate, trimethyl hexane diisocyanate, tetramethyl hexane and diisocyanate.

Specific examples of the alicyclic diisocyanate include, but are not limited to, isophorone diisocyanate and cyclohexylmethane diisocyanate.

Specific examples of the aromatic diisocyanate include, but are not limited to, tolylene diisocyanate, diisocyanato diphenyl methane, 1,5-nephthylene diisocyanate, 4, 4'-diisocyanato diphenyl, 4, 4'-diisocyanato-3, 3'-dimethyldiphenyl, 4, 4'-diisocyanato-3-methyldiphenyl methane and 4, 4'-diisocyanato-diphenyl ether.

Specific examples of the aromatic aliphatic diisocyanate include, but are not limited to, α,α,α',α'-tetramethylxylene diisocyanate.

Specific examples of the isocyanurate include, but are not limited to, tris(isocyanatoalkyl)isocyanurate and tris(isocyanatocycloalkyl)isocyanurate.

These polyisocyanates may be used alone or in combination, and are preferably used as precursors before reaction (prepolymer) reacting with a curing agent mentioned later.

—Curing Agent—

The curing agent is not particularly limited and may be appropriately selected depending on the intended purpose, so long as it can react with the prepolymer. Examples thereof include an active hydrogen group-containing compound.

——Active Hydrogen Group-Containing Compound——

An active hydrogen group in the active hydrogen group-containing compound is not particularly limited and may be appropriately selected depending on the intended purpose. Examples thereof include a hydroxyl group (e.g., an alcoholic hydroxyl group, and a phenolic hydroxyl group), an amino group, a carboxyl group, and a mercapto group. These may be used alone or in combination.

The active hydrogen group-containing compound is preferably amines, because it can form a urea bond.

Specific examples of the amines include, but are not limited to, diamine, trivalent or higher amine, amino alcohol, amino mercaptan, amino acid and compounds in which the amino groups of the foregoing compounds are blocked. These may be used alone or in combination Among them, diamine, and a mixture of diamine and a small amount of tri- or higher valent amine are preferably used.

Specific examples of the diamine include, but are not limited to, aromatic diamine, alicyclic diamine and aliphatic diamine.

Specific examples of the aromatic diamine include, but are not limited to, phenylenediamine, diethyl toluene diamine and 4, 4'-diaminodiphenylmethane.

Specific examples of the alicyclic diamine include, but are not limited to, 4, 4'-diamino-3, 3'-dimethyldicyclohexyl methane, diamino cyclohexane and isophoronediamine.

Specific examples of the aliphatic diamine include, but are not limited to, ethylene diamine, tetramethylene diamine and hexamethylenediamine.

Specific examples of the tri- or higher valent amine include, but are not limited to, diethylenetriamine and triethylene tetramine.

Specific examples of the amino alcohol include, but are not limited to, ethanol amine and hydroxyethyl aniline.

Specific examples of the amino mercaptan include, but are not limited to, aminoethyl mercaptan and aminopropyl mercaptan.

Specific examples of the amino acid include, but are not limited to, amino propionic acid and amino caproic acid.

Specific examples of the compound where the amino group is blocked include, but are not limited to, a ketimine compound where the amino group is blocked with ketone such as acetone, methyl ethyl ketone, methyl isobutyl ketone and an oxazoline compound.

In order to lower a Tg of the amorphous polyester resin to be deformed at low temperature, the amorphous polyester resin preferably includes a diol component including aliphatic diol having 4 to 12 carbon atoms in an amount not less than 50% by weight based on the total weight of the diol component.

In addition, the amorphous polyester resin preferably includes a diol component including aliphatic diol having 4 to 12 carbon atoms in an amount not less than 50% by weight based on the total weight of the alcoholic component for the same purpose.

Further, the amorphous polyester resin preferably includes a dicarboxylic acid component including aliphatic dicarboxylic acid having 4 to 12 carbon atoms in an amount not less than 50% by weight based on the total weight of the dicarboxylic acid component for the same purpose.

The amorphous polyester resin preferably has a glass transition temperature of from −60° C. to 0° C., and more preferably from −40° C. to −20° C. When not lower than −60° C., problems that the fluidity of the toner at low temperature is uncontrollable, and that heat resistant preservability and filming resistance deteriorate are effectively prevented. When not higher than 0° C., problems that the toner is not sufficiently deformed with heat and pressure when fixed, and that low-temperature fixability is insufficient are effectively prevented.

A weight-average molecular weight of the polyester resin is not particularly limited and may be appropriately selected depending on the intended purpose, but preferably from 20,000 to 1,000,000 as measured by GPC. The weight-average molecular weight of the polyester resin is a molecular weight of a reaction product between the nonlinear reactive precursor and the curing agent. When not less than 20,000, problems that the toner is likely to be fluid at low temperature and may deteriorate in heat resistant preservability, and that the toner has low viscosity when melted and may deteriorate in hot offset resistance are effectively prevented.

A molecular structure of the amorphous polyester resin can be measured by solution-state or solid-state NMR, X-ray diffraction, GC/MS, LC/MS, or IR spectroscopy. Simple methods for confirming the molecular structure thereof include a method for detecting, as the polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

The content of the amorphous polyester resin used as a prepolymer is not particularly limited and may be appropriately selected depending on the intended purpose, but preferably from 5 parts to 25 parts by mass, and more preferably from 10 to 20 parts by mass per 100 parts by mass of the toner. When less than 5 parts by mass, the toner may deteriorate in low-temperature fixability and hot offset resistance. When greater than 25 parts by mass, heat resistant preservability of the toner and glossiness of images after fixed may deteriorate. When the content is from 10 to 20 parts by mass, the toner advantageously has good low-temperature fixability, hot offset resistance and heat resistant preservability.

<<Crystalline Polyester Resin>>

Having crystallinity, the crystalline polyester resin has heat meltability quickly having low viscosity around a fixation starting temperature, and may be used with the amorphous polyester resin. When the crystalline polyester resin having such properties is used together with the amorphous polyester resin, the toner has good heat resistant preservability due to crystallinity just before a melt starting temperature. At the melt starting temperature, the toner quickly decreases in viscosity due to melting of the crystalline polyester resin. Then, the crystalline polyester resin is compatible with an amorphous polyester resin, and they quickly decrease in viscosity together to obtain a toner having good heat resistant preservability and low-temperature fixability. In addition, a release width (a difference between a fixable minimum temperature and a temperature at which hot offset occurs) has a good result.

The crystalline polyester resin is obtained by polymerizing polyols; and polycarboxylic acids such as polycarboxylic acids, polycarboxylic acid anhydrides and polycarboxylic acid esters or their derivatives.

In the present invention, modified polyester resins such as the prepolymer and resins obtained by crosslinking and/or elongating the prepolymer do not belong to the crystalline polyester resin.

The crystalline polyester resin preferably has a half-value width less than 1.0°/2θ in its X-ray diffraction, and more preferably less than 0.6°/2θ.

When less than 1.0°/2θ, problems that the crystalline polyester resin has low crystallinity and poor sharp meltability, and that the resultant toner has insufficient low-temperature fixability are effectively prevented.

The crystalline polyester resin preferably has a half-value width less than 1.0° in its X-ray diffraction, and more preferably less than 0.6° after dissolved in an organic solvent and recrystallized. When less than 1.00, problems that the crystalline polyester resin has low crystallinity and 1 partially compatible with the amorphous polyester, the resultant toner deteriorates in low-temperature fixability and heat resistant preservability, filming of the crystalline polyester resin tends to occur, and that contamination of the image developer and deterioration of image quality occur are effectively prevented.

<<<Measurement of Peak Half-Value Width by X-Ray Diffraction Measurement>>>

X-ray diffraction measurement of the crystalline polyester can be measured by a crystal analysis X-ray diffractometer X'Pert Pro MRD from Philips N.V. as follows. First, a sample is ground in a mortar to prepare a powder thereof. The sample powder is uniformly applied on a sample holder. The sample holder is set in the diffractometer to obtain a diffraction spectrum.

Diffraction peaks obtained within a range of the diffraction peaks 20°<2θ<25° are defined as P1, P2 . . . in order of peak intensity.

Figure 3:
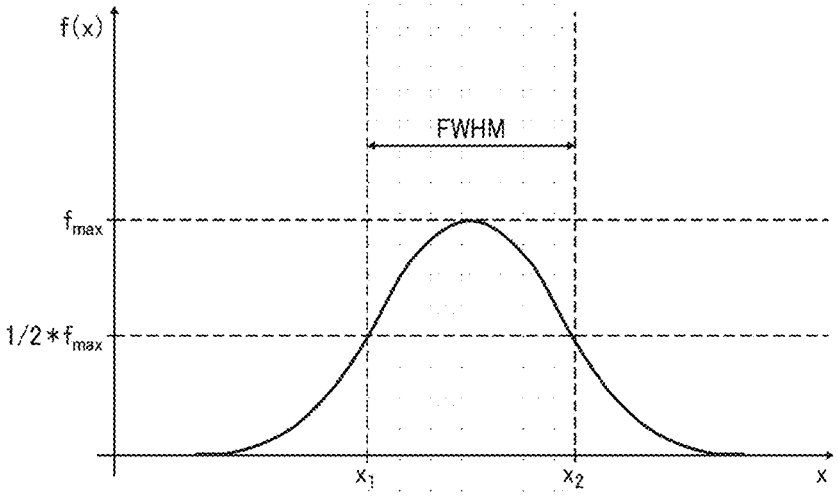
FIG. 3 is a schematic diagram for explaining a peak half value width of a crystalline polyester.

A peak half-value width (FWHM) is defined as a difference between points x1 and x2 (x2−x1) which are half of maximum peak intensity as shown in FIG. 3.

Conditions of the X-ray diffraction analysis are as follows.

Tension kV: 45 kV

Current: 40 A

MPSS

Upper

Gonio

Scanmode: continuous

Start angle: 3°

End angle: 35°

Angle Step: 0.02°

Lucident Beam Optics

Divergence slit: Div slit ½

Difflection Beam Optics

Anti scatter slit: As Fixed ½

Receiving slit: Prog rec slit

<<<Method of Dissolving Crystalline Polyester in Organic Solvent and Recrystallizing Crystalline Polyester>>>

A method of dissolving the crystalline polyester in an organic solvent and recrystallizing the crystalline polyester is as follows.

Ten (10) g of the crystalline polyester and 90 g of an organic solvent are stirred at 70° C. for 1 hr.

After stirred, the solution is cooled at 20° C. for 12 hrs to recrystallize the crystalline polyester.

The organic solvent dispersion after the crystalline polyester is recrystallized is filtered under reduced pressure by an aspirator with a Kiriyama funnel and Kiriyama filter No. 4 from Kiriyama Glass Works Co. to separate the crystalline polyester from the organic solvent.

The separated crystalline polyester is dried at 35° C. for 48 hrs to obtain the recrystallized crystalline polyester.

Details of constituents of the crystalline polyester resin are as follows.

—Polyol—

The polyol is not particularly limited and may be appropriately selected depending on the intended purpose. Examples thereof include diol, and tri- or higher valent alcohol.

Specific examples of the diol include saturated aliphatic diol, etc. Specific examples of the saturated aliphatic diol include straight chain saturated aliphatic diol, and branched-chain saturated aliphatic diol. Among them, straight chain saturated aliphatic diol is preferably used, and straight chain saturated aliphatic diol having 2 to 12 carbon atoms is more preferably used. When the saturated aliphatic diol has a branched-chain structure, crystallinity of the crystalline polyester resin may be low, and thus may lower the melting point. When the number of carbon atoms in the saturated aliphatic diol is greater than 12, it may be difficult to yield a material in practice. The number of carbon atoms is preferably not greater than 12.

Specific examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,1-undecanediol, 1,12-dodecanediol, 1,13-tridecanediol, 1,14-tetradecanediol, 1,18-octadecanediol, 1,14-eicosanedecanediol, etc. Among them, ethylene glycol, 1,4-butanediol, 1,6-hexanediol, 1,8-octanediol, 1,10-decanediol, and 1,12-dodecanediol are preferably used, as they give high crystallinity to a resulting crystalline polyester resin, and give excellent sharp melt properties. Specific examples of the tri- or higher valent alcohol include glycerin, trimethylol ethane, trimethylolpropane, pentaerythritol, etc. These may be used alone or in combination.

—Polycarboxylic Acid—

The multivalent carboxylic acid is not particularly limited and may be appropriately selected depending on the intended purpose. Examples thereof include divalent carboxylic acid, and tri- or higher valent carboxylic acid.

Specific examples of the divalent carboxylic acid include saturated aliphatic dicarboxylic acids such as an oxalic acid, a succinic acid, a glutaric acid, an adipic acid, a suberic acid, an azelaic acid, a sebacic acid, a 1,9-nonanedicarboxylic acid, a 1,10-decanedicarboxylic acid, a 1,12-dodecanedicarboxylic acid, a 1,14-tetradecanedicarboxylic acid, and a 1,18-octadecanedicarboxylic acid; aromatic dicarboxylic acids of dibasic acid such as a phthalic acid, an isophthalic acid, a terephthalic acid, a naphthalene-2,6-dicarboxylic acid, a malonic acid, a and mesaconic acid; and anhydrides of the foregoing compounds, and lower (having 1 to 3 carbon atoms) alkyl ester of the foregoing compounds, etc.

Specific examples of the tri- or higher valent carboxylic acid include 1,2,4-benzenetricarboxylic acid, 1,2,5-benzenetricarboxylic acid, 1,2,4-naphthalene tricarboxylic acid, anhydrides thereof, and lower (having 1 to 3 carbon atoms) alkyl esters thereof, etc.

Moreover, the polycarboxylic acid may contain, other than the saturated aliphatic dicarboxylic acid or aromatic dicarboxylic acid, dicarboxylic acid containing a sulfonic acid group. Further, the polycarboxylic acid may contain, other than the saturated aliphatic dicarboxylic acid or aromatic dicarboxylic acid, dicarboxylic acid having a double bond. These may be used alone or in combination.

The crystalline polyester resin is preferably composed of a straight chain saturated aliphatic dicarboxylic acid having 4 to 12 carbon atoms and a straight chain saturated aliphatic diol having 2 to 12 carbon atoms. Namely, the crystalline polyester resin preferably includes a structural unit coming from a saturated aliphatic dicarboxylic acid having 4 to 12 carbon atoms and a structural unit coming from a saturated aliphatic diol having 2 to 12 carbon atoms. As a result of this, the crystalline polyester resin has high crystallinity and good sharp meltability, and the resultant toner has good low-temperature fixability.

A melting point of the crystalline polyester resin is not particularly limited and may be appropriately selected depending on the intended purpose, but it is preferably 60° C. to 80° C. When the melting point thereof is less than 60° C., the crystalline polyester resin tends to melt at low temperature, which may impair heat resistant preservability of the toner. When the melting point thereof is greater than 80° C., melting of the crystalline polyester resin with heat applied during fixing may be insufficient, which may impair low-temperature fixability of the toner.

A molecular weight of the crystalline polyester resin is not particularly limited and may be appropriately selected depending on the intended purpose. Since those having a sharp molecular weight distribution and low molecular weight have excellent low-temperature fixability, and heat resistant preservability of the resultant toner lowers as an amount of a low molecular weight component, an o-dichlorobenzene soluble component of the crystalline polyester resin preferably has the weight average molecular weight (Mw) of 3,000 to 30,000, number average molecular weight (Mn) of 1,000 to 10,000, and Mw/Mn of 1.0 to 10, as measured by GPC. Further, it is more preferred that the weight average molecular weight (Mw) thereof be 5,000 to 15,000, the number average molecular weight (Mn) thereof be 2,000 to 10,000, and the Mw/Mn be 1.0 to 5.0.

An acid value of the crystalline polyester resin is not particularly limited and may be appropriately selected depending on the intended purpose, but it is preferably not less than 5 mg KOH/g, more preferably not less than 10 mg KOH/g for achieving the desired low-temperature fixability in view of affinity between paper and the resin. Meanwhile, the acid value thereof is preferably 45 mg KOH/g or lower for the purpose of improving hot offset resistance.

A hydroxyl value of the crystalline polyester resin is not particularly limited and may be appropriately selected depending on the intended purpose. However, it is preferably 0 mg KOH/g to 50 mg KOH/g, more preferably 5 mg KOH/g to 50 mg KOH/g, in order to achieve the desired low-temperature fixability and excellent charging property.

A molecular structure of the crystalline polyester resin can be measured by solution-state or solid-state NMR, X-ray diffraction, GC/MS, LC/MS, or IR spectroscopy. Simple methods for confirming the molecular structure thereof include a method for detecting, as a crystalline polyester resin, one that has absorption based on CH (out-of-plane bending vibration) of olefin at 965 $cm^{-1}$±10 $cm^{-1}$ and 990 $cm^{-1}$±10 $cm^{-1}$ in an infrared absorption spectrum.

The content of the crystalline polyester resin is not particularly limited and may be appropriately selected depending on the intended purpose, but it is preferably 3 to 20 parts by mass, more preferably 5 to 15 parts by mass, relative to 100 mass by mass of the toner. When the amount thereof is less than 3 parts by mass, the crystalline polyester resin is insufficient in sharp melt property, and thus the resultant may be deteriorated in heat resistant preservability. When it is greater than 20 parts by mass, the resultant toner may be deteriorated in heat resistant preservability, and fogging of an image may be caused. When the amount thereof is within more preferable range than the aforementioned range, it is advantageous that the resultant toner is excellent in both high image quality and low-temperature fixability.

<Other Toner Constituents>

Examples of other toner constituents include a release agent, a colorant, a charge controlling agent, an external additive, a fluidity improver, a cleanability improver, and a magnetic material.

—Release Agent—

Specific examples of wax serving as the release agent include natural wax such as vegetable wax (e.g., carnauba wax, cotton wax, Japan wax and rice wax), animal wax (e.g., bees wax and lanolin), mineral wax (e.g., ozokelite and ceresine) and petroleum wax (e.g., paraffin wax, microcrystalline wax and petrolatum).

Specific examples of the wax other than the above natural wax include a synthetic hydrocarbon wax (e.g., Fischer-Tropsch wax and polyethylene wax; and a synthetic wax (e.g., ester wax, ketone wax and ether wax).

Further, other examples of the release agent include fatty acid amides such as 12-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, a hydrocarbon wax such as a paraffin wax, a microcrystalline wax, a Fischer-Tropsch wax, a polyethylene wax, and a polypropylene wax is preferably used. A melting point of the release agent is not particularly limited and may be appropriately selected depending on the intended purpose, but it is preferably 60° C. to 80° C. When the melting point thereof is not less than 60° C., problems that the release agent tends to melt at low temperature, and that heat resistant preservability is deteriorated are prevented. When the melting point thereof is not greater than 80° C., problems that the release agent does not sufficiently melt to thereby cause fixing offset, even in the case where the resin is in the fixing temperature range, which may cause defects in an image are effectively prevented.

The content of the release agent is appropriately selected depending on the intended purpose without any limitation, but it is preferably 2 parts to 10 parts by mass, more preferably 3 parts to 8 parts by mass, relative to 100 parts by mass of the toner. When the amount thereof is not less than 2 parts by mass, problems that the resultant toner may have insufficient hot offset resistance, and low-temperature fixability during fixing are effectively prevented. When the amount thereof is not greater than 10 parts by mass, problems that the resultant toner may have insufficient heat resistant preservability, and tends to cause fogging in an image are effectively prevented. When the content thereof is within the aforementioned more preferable range, it is advantageous because image quality and fixing stability can be improved.

—Colorant—

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

The content of the colorant is not particularly limited and may be appropriately selected depending on the intended purpose, but it is preferably 1 to 15 parts by mass, more preferably 3 to 10 parts by mass, relative to 100 parts by mass of the toner.

The colorant may be used as a master batch in which the colorant forms a composite with a resin. As a resin used in the production of the master batch or a resin kneaded together with the master batch, other than the another polyester resin, polymer of styrene or substitution thereof (e.g., polystyrene, poly-p-chlorostyrene, and polyvinyl toluene); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax can be used. These may be used alone or in combination.

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

—Charge Controlling Agent—

The charge controlling agent is not particularly limited and may be appropriately selected depending on the intended purpose. Examples thereof include a nigrosine-based dye, a triphenylmethane-based dye, a chromium-containing metallic complex dye, a molybdic acid chelate pigment, a rhodamine-based dry, alkoxy-based amine, a quaternary ammonium salt (including a fluorine-modified quaternary ammonium salt), alkylamide, a simple substance or a compound of phosphorus, a simple substance or a compound of tungsten, a fluorine-based activator, a salicylic acid metallic salt, a metallic salt of salicylic acid derivative, etc. Specific examples thereof include a nigrosine dye BONTRON 03, a quaternary ammonium salt BONTRON P-51, a metal-containing azo dye BONTRON S-34, an oxynaphthoic acid-based metal complex E-82, a salicylic acid-based metal complex E-84 and a phenol condensate E-89 (all products of ORIENT CHEMICAL INDUSTRIES CO., LTD.); quaternary ammonium salt molybdenum complexes TP-302 and TP-415 (all products of Hodogaya Chemical Co., Ltd.); LRA-901; a boron complex LR-147 (product of Japan Carlit Co., Ltd.); a copper phthalocyanine; perylene; quinacridone; an azo-pigment; and polymeric compounds having, as a functional group, a sulfonic acid group, carboxyl group, quaternary ammonium salt, etc.

The content of the charge controlling agent is not particularly limited and may be appropriately selected depending on the intended purpose, but it is preferably 0.1 to 10 parts by mass, more preferably 0.2 to 5 parts by mass, relative to 100 parts by mass of the toner. When the amount thereof is not greater than 10 parts by mass, problems that the charging ability of the toner becomes excessive, which may reduce the effect of the charge controlling agent, increase electrostatic force to a developing roller, leading to low flowability of the developer, or low image density of the resulting image are effectively prevented. These charge controlling agents may be dissolved and dispersed after being melted and kneaded together with the master batch, and/or resin. The charge controlling agents can be, of course, directly added to an organic solvent when dissolution and dispersion is performed.

Alternatively, the charge controlling agents may be fixed on surfaces of toner particles after the production of the toner particles.

—External Additive—

Specific examples of the external additives include, but are not limited to, hydrophobized silica, titania, titanium oxide and alumina fine particles. The hydrophobized fine particles can be obtained by subjecting hydrophilic fine particles to surface treatment with silane coupling agents such as methyltrimethoxy silane, methyltriethoxy silane and octyltrimethoxy silane.

Specific examples of the hydrophobized silica fine particles include R972, R974, RX200, RY200, R202, R805, and R812 from Nippon Aerosil Co., Ltd., etc.

Specific examples of the hydrophobized titania fine particles include P-25 from Nippon Aerosil Co., Ltd.; STT-30, and STT-65C-S from Fuji Titanium Industry Co., Ltd.; TAF-140 from Fuji Titanium Industry Co., Ltd.; and MT-150W, MT-500B, MT-600B and MT-150A from Tayca Corporation, etc.

The content of the external additive is not particularly limited and may be appropriately selected depending on the intended purpose, but it is preferably 0.1 parts to 5 parts by mass, more preferably 0.3 parts to 3 parts by mass, relative to 100 parts by mass of the toner.

<Toner Properties>

The toner preferably has a glass transition temperature (Tg1st) of from 20° C. to 50° C., where the glass transition temperature (Tg1st) is a glass transition temperature measured in first heating of differential scanning calorimetry (DSC) of the toner.

The toner of the present invention tends to have a lower Tg than the conventional toners. However, since the amorphous polyester resin is nonlinear, the toner of the present invention can retain heat resistant preservability. In particular, when the polyester resin has a urethane bond or a urea bond responsible for high aggregation force, the resultant toner may significantly exhibit more excellent effects in heat resistant preservability.

The toner preferably has a glass transition temperature (Tg1st) of from 20° C. to 50° C., and a glass transition temperature (Tg2nd) of from 0° C. to 30° C., where the glass transition temperatures (Tg1st & Tg2nd) are glass transition temperatures measured in first heating and second heating of differential scanning calorimetry (DSC) of the toner, respectively. A difference (Tg1st-Tg2nd) is not particularly limited and may be appropriately selected depending on the intended purpose, but preferably not less than 10° C. An upper limit of the difference is not particularly limited and may be appropriately selected depending on the intended purpose, but the difference is preferably not greater than 50° C.

In the toner of the present invention using the crystalline polyester resin, the crystalline polyester and the polyester resin are compatible with each other after the first heating, which are present incompatible with each other before the first heating.

When the Tg1st is not less than 20° C., problems that the toner may be deteriorated in heat resistant preservability, and that blocking within a developing unit and filming on a photoconductor may be caused are prevented. When the Tg1st is not greater than 50° C., deterioration of low-temperature fixability thereof is prevented. When the Tg2nd is not less than 0° C., a problem that the fixed image (printed matter) may deteriorate in anti-blocking within a developing unit is prevented. When greater than 30° C., problems that the toner may not have sufficient low-temperature fixability and glossiness are prevented.

A volume-average particle diameter of the toner is not particularly limited and may be appropriately selected depending on the intended purpose, but it is preferably 3 μm to 7 μm. Moreover, a ratio of the volume average particle diameter to the number average particle diameter is preferably not greater than 1.2. Further, the toner preferably contains toner particles having the volume average particle diameter of 2 μm or less, in an amount of 1% by number to 10% by number.

<Methods of Calculating and Analyzing Properties of Toner and Toner Constituents>

The Tg, acid value, hydroxyl value, molecular weight and melting point of each of the amorphous polyester resin, crystalline polyester resin and release agent may be measured from each of the constituents. The toner may be subjected to gel permeation chromatography (GPC) to separate each component to calculate a SP value, a Tg, a molecular weight, a melting point and a mass ratio thereof.

The weight-average molecular weights of the toner and the resin were measured by a GPC measurer GPC-150C from Waters Corp. KF801 to 807 from Shodex is used as a column and an RI (refraction index) detector is used as the detector.

Separation of each component by GPC can be performed, for example, by the following method.

In GPC measurement using THF (tetrahydrofuran) as a mobile phase, an eluate is subjected to fractionation by a fraction collector, a fraction corresponding to a part of a desired molecular weight is collected from a total area of an elution curve.

The combined eluate is concentrated and dried by an evaporator or the like, and a resulting solid content is dissolved in a deuterated solvent, such as deuterated chloroform, and deuterated THF, followed by measurement of $^{1}$H-NMR. From an integral ratio of each element, a ratio of a constituent monomer of the resin in the elution composition is calculated.

As another method, after concentrating the eluate, hydrolysis is performed with sodium hydroxide or the like, and a ratio of a constituent monomer is calculated by subjecting the decomposed product to a qualitative and quantitative analysis by high performance liquid chromatography (HPLC).

Note that, in the case where the toner is produced by generating the amorphous polyester resin through a chain-elongation reaction and/or crosslink reaction of the non-linear reactive precursor and the curing agent to thereby produce toner base particles, the polyester resin may be separated from an actual toner by GPC or the like, to thereby determine a Tg thereof. Alternatively, the toner may be produced by synthesizing the amorphous polyester resin A through a chain-elongation reaction and/or crosslink reaction of the non-linear reactive precursor and the curing agent, to thereby measure a Tg thereof from the synthesized amorphous polyester resin.

<<<Means for Separating Toner Constituents>>

One example of a separation unit for each component during an analysis of the toner will be specifically explained hereinafter.

First, 1 g of a toner is added to 100 mL THF, and the resulting mixture is stirred for 30 min at 25° C., to thereby obtain a solution in which soluble components are dissolved.

The solution is then filtered through a membrane filter having an opening of 0.2 μm, to thereby obtain THF soluble matter in the toner.

Next, the THF soluble matter are dissolved in THF, to thereby prepare a sample for measurement of GPC, and the prepared sample is supplied to GPC used for molecular weight measurement of each resin mentioned above.

Meanwhile, a fraction collector is disposed at an eluate outlet of GPC, to fraction the eluate per a certain count. The eluate is obtained per 5% in terms of the area ratio from the elution onset on the elution curve (raise of the curve).

Next, each eluted fraction, as a sample, in an amount of 30 mg is dissolved in 1 mL of deuterated chloroform, and to this solution, 0.05% by volume of tetramethyl silane (TMS) is added as a standard material. A glass tube for NMR having a diameter of 5 mm is charged with the solution, from which a spectrum is obtained by a nuclear magnetic resonance apparatus (JNM-AL 400, product of JEOL Ltd.) by performing multiplication 128 times at temperature of from 23° C. to 25° C.

The monomer compositions and the compositional ratios of the amorphous polyester resin, the amorphous polyester resin and the crystalline polyester resin in the toner are determined from peak integral ratios of the obtained spectrum.

For example, peaks are grouped as follows, and a component ratio of constitutional monomers is determined from an integrated ratio of each of the group.

Near 8.25 ppm: from a benzene ring of trimellitic acid (one hydrogen atom)

Near 8.07 ppm to 8.10 ppm: from a benzene ring of terephthalic acid (4 hydrogen atoms)

Near 7.1 ppm to 7.25 ppm: from a benzene ring of bisphenol A (4 hydrogen atoms)

Near 6.8 ppm: from a benzene ring of bisphenol A (4 hydrogen atoms) and a double bond of fumaric acid (2 hydrogen atoms)

Near 5.2 ppm to 5.4 ppm: from methylene of an adduct of bisphenol A with propylene oxide (one hydrogen atom)

Near 3.7 ppm to 4.7 ppm: from methylene of an adduct of bisphenol A with propylene oxide (2 hydrogen atoms) and methylene of an adduct of bisphenol A with ethylene oxide (4 hydrogen atoms)

Near 1.6 ppm: from a methyl group of bisphenol A (6 hydrogen atoms)

From these results, for example, an abstract collected in a fraction occupied by the amorphous polyester resin by not less than 90% can be regarded as the amorphous polyester resin.

Similarly, an abstract collected in a fraction occupied by the crystalline polyester resin by not less than 90% can be regarded as the crystalline polyester resin.

<<<Methods of Measuring Melting Point and Glass Transition Temperature (Tg)>>>

In the present invention, a melting point and a glass transition temperature (Tg) of the toner can be measured, for example, by a differential scanning calorimeter (DSC) system (Q-200, product of TA Instruments Japan Inc.).

Specifically, a melting point and a glass transition temperature of samples can be measured in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by a differential scanning calorimeter (Q-200, product of TA Instruments Japan Inc.).

The DSC curve for the first heating is selected from the obtained DSC curve by an analysis program stored in the Q-200 system, to thereby determine a glass transition temperature of the sample with the first heating (Tg1st). Similarly, the DSC curve for the second heating is selected, and the glass transition temperature of the sample with the second heating (Tg2nd) can be determined.

Moreover, the DSC curve for the first heating is selected from the obtained DSC curve by the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

Moreover, in the present invention, regarding the glass transition temperature and the melting point of the amorphous polyester resin, the crystalline polyester resin and the other constituent components such as the release agent, the endothermic peak top temperature and the Tg in second heating are defined as the melting point and the Tg of each of the target samples, respectively, unless otherwise specified.

<Toner Production Method>

The metal complex or the salt of the aromatic carboxylic acid derivative is thought to crosslink with a polyester resin in the toner when heated to increase a molecular weight of the binder resin present at the surface of the loner and harden the surface thereof.

The metal complex or the salt of the aromatic carboxylic acid derivative is made to adhere to the surface of the toner at not higher than 70° C. When higher than 70° C., the crosslinking reaction with the toner progresses in this adhering process and storage modulus of the toner increases to impair low-temperature fixability of the toner.

The metal complex or the salt of the aromatic carboxylic acid derivative is preferably made to only adhere to the surface of the toner to effectively harden the surface thereof without impairing low-temperature fixability thereof.

Methods of making a metal compound adhere to the surface of the toner include a method of making a metal compound adhere in an aqueous phase.

The metal complex or the salt of the aromatic carboxylic acid derivative is preferably made to adhere to a polymerization toner in an aqueous phase because there is a process of dispersing constituents of the toner in an aqueous phase when preparing a toner. A fine dispersion solution of the metal complex or the salt of the aromatic carboxylic acid derivative is placed in an aqueous phase in which the toner is present and aggregated with an acid or a salt to adhere to the surface of the toner.

Namely, when preparing the toner, there preferably is a process of adding a dispersion in which particles of the metal complex or the salt of the aromatic carboxylic acid derivative are dispersed to have a volume-average particle diameter not greater than 1.0 μm to a dispersion in which particles not including the metal complex or the salt of the aromatic carboxylic acid derivative.

After particles of the metal complex or the salt of the aromatic carboxylic acid derivative are made to adhere to the surface of the toner, the aqueous phase is preferably heated to have a temperature of from 40° C. to 70° C. and kept as it is to increase adherence of the particles to the surface of the toner. This stably fix the metal complex or the salt of the aromatic carboxylic acid derivative on the surface of the toner.

When the metal complex or the salt of the aromatic carboxylic acid derivative is made to adhere to the surface of the toner, not dispersed therein, many crosslinking reactions due to the metal complex or the salt of the aromatic carboxylic acid derivative are made on the surface of a fixed image to more effectively improve anti-blocking of ejected papers and image preservability.

A method for producing the toner is not particularly limited and may be appropriately selected depending on the intended purpose such as polymerization methods and pulverization methods. The base toner is preferably granulated by dispersing an oil phase in an aqueous medium, where the oil phase contains the amorphous polyester resin and the crystalline polyester resin, and further contains the release agent and the colorant if necessary.

Moreover, the toner is more preferably granulated by dispersing an oil phase in an aqueous medium, where the oil phase contains a polyester resin which is a prepolymer including a urethane bond and a urea bond as the amorphous polyester resin, the crystalline polyester resin, and further contains the curing agent, the release agent, and the colorant if necessary.

One example of such methods for producing the toner base particle is a known dissolution suspension method. As one example of the methods for producing the toner base particle, a method for forming toner base particles while forming the amorphous polyester resin through elongating reaction and/or cross-linking reaction between the prepolymer and the curing agent will be described hereinafter. This method includes preparing an aqueous medium, preparing an oil phase containing toner materials, emulsifying or dispersing the toner materials, and removing an organic solvent.

The present invention further includes a process of preparing a fine dispersion of the metal complex or the salt of the aromatic carboxylic acid derivative and a process of making the metal complex or the salt of the aromatic carboxylic acid derivative adhere to the surface of the toner.

—Preparation of Aqueous Medium—

The preparation of the aqueous phase can be carried out, for example, by dispersing resin particles in an aqueous medium. An amount of the resin particles added to the aqueous medium is not particularly limited and may be appropriately selected depending on the intended purpose, but it is preferably 0.5 parts to 10 parts by mass relative to 100 parts by weight of the aqueous medium.

The aqueous medium is not particularly limited and may be appropriately selected depending on the intended purpose. Examples thereof include water, a solvent miscible with water, and a mixture thereof. These may be used alone or in combination of two or more thereof. Among them, water is preferable.

The solvent miscible with water is not particularly limited and may be appropriately selected depending on the intended purpose. Examples thereof include alcohol, dimethyl formamide, tetrahydrofuran, cellosolve, and lower ketone. The alcohol is not particularly limited and may be appropriately selected depending on the intended purpose. Examples thereof include methanol, isopropanol, and ethylene glycol. The lower ketone is not particularly limited and may be appropriately selected depending on the intended purpose. Examples thereof include acetone and methyl ethyl ketone.

—Preparation of Oil Phase—

Preparation of the oil phase containing the toner materials can be performed by dissolving or dispersing toner materials in an organic solvent, where the toner materials contain at least the non-linear reactive precursor, the amorphous polyester resin and the crystalline polyester resin, and further contain the curing agent, the release agent, the colorant, if necessary.

The organic solvent is not particularly limited and may be appropriately selected depending on the intended purpose, but it is preferably an organic solvent having a boiling point of less than 150° C., as removal thereof is easy.

The organic solvent having the boiling point of less than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination.

Among them, ethyl acetate, toluene, xylene, benzene, methylene chloride, 1,2-dichloroethane, chloroform, and carbon tetrachloride are preferably used, and ethyl acetate is more preferably used.

—Preparation of Fine Dispersion of Metal Complex or Salt of Aromatic Carboxylic Acid Derivative—

Fine particles of the metal complex or the salt of the aromatic carboxylic acid derivative such as a salt of salicylic acid derivative are thought to adhere to the surface by aggregation or pH control.

Fine particles of the salicylic acid derivative salt is obtained by mixing a salicylic acid derivative with a metal salt coordinately bondable with the salicylic acid derivative in water to form a precipitate.

This is preferably performed under a base because of deprotonation of a carboxyl group of the salicylic acid derivative.

The precipitate of the salicylic acid derivative salt is filtered and dispersed in water again. A surfactant is added thereto to prevent reaggregation, and the salicylic acid derivative salt is pulverized by beads mill, etc. to obtain fine particles thereof.

Particles of the metal complex or the salt of the aromatic carboxylic acid derivative are preferably dispersed to have a volume-average particle diameter not greater than 1.0 μm.

—Emulsification or Dispersion—

The emulsification or dispersion of the toner materials can be carried out by dispersing the oil phase containing the toner materials in the aqueous medium. In the course of the emulsification or dispersion of the toner materials, the curing agent and the prepolymer can perform a chain-elongation reaction and/or crosslinking reaction.

The reaction conditions (reaction time and temperature) to form the prepolymer are particularly limited and may be appropriately selected depending on a combination of the curing agent and the prepolymer.

The reaction time is not particularly limited and may be appropriately selected depending on the intended purpose, but it is preferably from 10 min to 40 hrs, more preferably from 2 to 24 hrs.

The reaction temperature is not particularly limited and may be appropriately selected depending on the intended purpose, but it is preferably 0° C. to 150° C., more preferably 30° C. to 50° C.

A method for stably forming the dispersion in the aqueous medium is not particularly limited and may be appropriately selected depending on the intended purpose. Examples thereof include a method for dispersing an oil phase, which is added to an aqueous medium, with shear force, where the oil phase is prepared by dissolving or dispersing toner materials in a solvent.

A disperser used for the dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser.

Among them, the high-speed shearing disperser is preferable, because it can control the particle diameters of the dispersed elements (oil droplets) to the range of from 2 μm to 20 μm.

In the case where the high-speed shearing disperser is used, the conditions for dispersing, such as the rotating speed, dispersion time, and dispersion temperature, may be appropriately selected depending on the intended purpose.

The rotational speed is not particularly limited and may be appropriately selected depending on the intended purpose, but it is preferably 1,000 rpm to 30,000 rpm, more preferably 5,000 rpm to 20,000 rpm.

The dispersion time is not particularly limited and may be appropriately selected depending on the intended purpose, but it is preferably 0.1 min to 5 min in case of a batch system.

The dispersion temperature is not particularly limited and may be appropriately selected depending on the intended purpose, but it is preferably 0° C. to 50° C., more preferably 30° C. to 45° C. under pressure. Note that, generally speaking, dispersion can be easily carried out, as the dispersion temperature is higher.

An amount of the aqueous medium used for the emulsification or dispersion of the toner material is not particularly limited and may be appropriately selected depending on the intended purpose, but it is preferably 50 to 2,000 parts by mass, more preferably 100 to 1,000 parts by mass, relative to 100 parts by mass of the toner material.

When the amount of the aqueous medium is less than 50 parts by mass, the dispersion state of the toner material is impaired, which may result a failure in attaining toner base particles having desired particle diameters. When the amount thereof is more than 2,000 parts by mass, the production cost may increase.

When the oil phase containing the toner material is emulsified or dispersed, a dispersant is preferably used for the purpose of stabilizing dispersed elements, such as oil droplets, and gives a sharp particle size distribution as well as giving desirable shapes of toner particles.

The dispersant is not particularly limited and may be appropriately selected depending on the intended purpose. Examples thereof include a surfactant, a water-insoluble inorganic compound dispersant, and a polymer protective colloid. These may be used alone or in combination. Among them, the surfactant is preferably used.

The surfactant is not particularly limited and may be appropriately selected depending on the intended purpose. Examples thereof include an anionic surfactant, a cationic surfactant, a nonionic surfactant, and an amphoteric surfactant.

The anionic surfactant is not particularly limited and may be appropriately selected depending on the intended purpose. Examples thereof include alkyl benzene sulfonic acid salts, α-olefin sulfonic acid salts and phosphoric acid esters. Among them, those having a fluoroalkyl group are preferably used.

—Removal of Organic Solvent and Adherence of Metal Complex or Salt of Aromatic Carboxylic Acid Derivative—

A method for removing the organic solvent from the dispersion liquid such as the emulsified slurry is not particularly limited and may be appropriately selected depending on the intended purpose. Examples thereof include: a method in which an entire reaction system is gradually heated to evaporate out the organic solvent in the oil droplets; and a method in which the dispersion liquid is sprayed in a dry atmosphere to remove the organic solvent in the oil droplets.

The organic solvent is removed to obtain a dispersion slurry. The dispersion slurry is subjected to washing and drying to obtain a filter cake, and a toner slurry liquid in which the filter cake is dispersed is obtained.

Following the washing and drying processes, a process of making the metal complex or the salt of the aromatic carboxylic acid derivative as a crosslinker adhere on the surface of the toner is performed. A dispersion in which the metal complex or the salt of the aromatic carboxylic acid derivative is dispersed to have a volume-average particle diameter not greater than 1.0 μm is prepared, and the dispersion is added to the toner slurry liquid in which particles not including the metal complex or the salt of the aromatic carboxylic acid derivative are dispersed.

When the metal complex or the salt of the aromatic carboxylic acid derivative such as the salicylic acid derivative salt is made to adhere on the surface of the toner, the salicylic acid derivative salt is thought to adhere thereon in the shape of particles. A dispersion in which particles of the salicylic acid derivative salt are dispersed and an acid or a salt as an aggregating agent are added to the toner slurry liquid to make the particles of the salicylic acid derivative salt adhere on the surface of the toner. In order to strengthen the adherence, continuous heating process within a temperature range in which crosslinking reaction with a binder resin does not occur is preferably performed.

This is the same when the metal complex or the salt of the aromatic carboxylic acid derivative is a hydroxy naphthoic acid salt.

Next, the toner slurry liquid in which particles of the metal complex or the salt of the aromatic carboxylic acid derivative adhere on the surface of the toner is filtered, dried and classified to obtain toner base particles.

The obtained toner base particles may be mixed with particles such as the external additive and the charge controlling agent. At this time, by applying a mechanical impact during mixing, the external additive can be prevented from fall off from surfaces of toner base particles.

The mechanical impact may be applied by any method without particular limitation and may be properly selected according to purposes. Examples thereof include a method that includes applying an impact to a mixture with a high-speed rotating blade and a method that includes introducing a mixture into a high-speed gas stream and accelerating the gas stream to allow the particles to collide against one another or the particles to collide against a proper collision plate.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

Thus, toner particles having a volume-average particle diameter of from 5.5 μm to 7 μm are obtained.

(Developer)

A developer of the present invention contains at least the toner, and may further contain appropriately selected other components, such as carrier, if necessary.

Accordingly, the developer has excellent transfer properties, and charging ability, and can stably form high quality images. Note that, the developer may be a one-component developer, or a two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is supplied and consumed repeatedly, the toner does not cause filming to a developing roller, nor fuse to a layer thickness regulating member such as a blade for thinning a thickness of a layer of the toner, and provides excellent and stable developing ability and image even when it is stirred in the developing device over a long period of time.

In the case where the developer is used as a two-component developer, the diameters of the toner particles in the developer do not vary largely even when the toner is supplied and consumed repeatedly, and the toner can provide excellent and stable developing ability even when the toner is stirred in the developing device over a long period of time.

<Carrier>

The carrier is appropriately selected depending on the intended purpose without any limitation, but it is preferably a carrier containing a core, and a resin layer covering the core.

—Core Material—

A material of the core is appropriately selected depending on the intended purpose without any limitation, and examples thereof include a 50 emu/g to 90 emu/g manganese-strontium (Mn—Sr) material, and a 50 emu/g to 90 emu/g manganese-magnesium (Mn—Mg) material. To secure a sufficient image density, use of a hard magnetic material such as iron powder (100 emu/g or more), and magnetite (75 emu/g to 120 emu/g) is preferable. Moreover, use of a soft magnetic material such as a 30 to 80 emu/g copper-zinc material is preferable because an impact applied to a photoconductor by the developer born on a bearer in the form of a brush can be reduced, which is an advantageous for improving image quality.

These may be used alone or in combination.

The volume-average particle diameter of the core material is not particularly limited and may be appropriately selected depending on the intended purpose, but it is preferably 10 μm to 150 μm, more preferably 40 μm to 100 μm. When the volume average particle diameter thereof is less than 10 μm, the proportion of particles in the distribution of carrier particle diameters increases, causing carrier scattering because of low magnetization per carrier particle. When the volume average particle diameter thereof is not greater than 150 μm, problems that the specific surface area reduces, which may cause toner scattering, causing deterioration of reproducibility especially in a solid image portion in a full color printing containing many solid image portions are prevented.

In the case where the toner is used for a two-component developer, the toner is used by mixing with the carrier. An amount of the carrier in the two-component developer is not particularly limited and may be appropriately selected depending on the intended purpose, but it is preferably 90 to 98 parts by mass, more preferably 93 to 97 parts by mass, relative to 100 parts by mass of the two-component developer.

A developer of the present invention may be suitably used in image formation by various known electrophotographic methods such as a magnetic one-component developing method, a non-magnetic one-component developing method, and a two-component developing method.

(Toner Housing Unit)

The toner housing unit in the present invention is a unit housing a toner.

Embodiments of the toner housing unit include a toner container, an image developer and a process cartridge.

The toner container is a container containing a toner.

The image developer is a developing means containing a toner.

The process cartridge includes at least an image bearer and an image developer, detachable from an image forming apparatus, and contains a toner. The process cartridge may further include at least one member selected from the group consisting of a charger, an irradiator and a cleaner.

The image forming apparatus equipped with the toner housing unit is capable of forming images with the toner having low-temperature fixability, anti-blocking of ejected papers and image preservability.

(Image Forming Apparatus and Image Forming Method)

An image forming apparatus of the present invention includes at least an electrostatic latent image bearer, an electrostatic latent image forming unit, and a developing unit, and if necessary, further includes other units.

An image forming method of the present invention includes at least an electrostatic latent image forming step and a developing step, and if necessary, further includes other steps.

The image forming method can preferably be executed by the image forming apparatus, the electrostatic latent image forming step can preferably be executed by the electrostatic latent image forming unit, the developing step can preferably be executed by the developing unit, and the other steps can preferably be executed by the other units.

<Electrostatic Latent Image Bearer>

The material, structure and size of the electrostatic latent image bearer are not particularly limited and may be appropriately selected depending on the intended purpose.

Examples of the material thereof include inorganic photoconductors such as amorphous silicon and selenium and organic photoconductors such as polysilane and phthalopolymethine.

Among them, amorphous silicon is preferable in terms of long lifetime.

<Electrostatic Latent Image Forming Unit>

The electrostatic latent image forming unit is not particularly limited and may be appropriately selected depending on the intended purpose so long as it is a unit to form an electrostatic latent image on the electrostatic latent image bearer. Examples thereof include a unit including at least a charging member to charge a surface of the electrostatic latent image bearer and an exposing member to imagewise expose the surface of the electrostatic latent image bearer to light.

—Charging Member and Charging—

The charging member is not particularly limited and may be appropriately selected depending on the intended purpose. Examples thereof include contact-type charging devices known per se having, for example, an electrically conductive or semiconductive roller, brush, film and rubber blade; and non-contact-type charging devices utilizing corona discharge such as corotron and scorotron.

The charging can be performed by, for example, applying voltage to the surface of the electrostatic latent image bearer by using the charging member.

The charging member may have any shape like a charging roller as well as a magnetic brush or a fur brush. The shape of the charging member may be suitably selected according to the specification or configuration of the image forming apparatus.

The charging member is not limited to the aforementioned contact-type charging members. However, the contact-type charging members are preferably used because an image forming apparatus in which an amount of ozone generated from the charging members is reduced can be obtained —Irradiation Member and Irradiation—

The irradiation member is not particularly limited and may be appropriately selected depending on the purpose so long as it attains desired imagewise irradiation on the surface of the electrophotographic latent image bearer charged with the charging member. Examples thereof include various irradiation members such as a copy optical irradiation device, a rod lens array irradiation device, a laser optical irradiation device, and a liquid crystal shutter irradiation device.

A light source used for the irradiation member is not particularly limited and may be appropriately selected depending on the intended purpose. Examples thereof include conventional light-emitting devices such as a fluorescent lamp, a tungsten lamp, a halogen lamp, a mercury lamp, a sodium lamp, a light-emitting diode (LED), a laser diode (LD), and an electroluminescence (EL) device.

Also, various filters may be used for emitting only light having a desired wavelength range. Examples of the filters include a sharp-cut filter, a band-pass filter, an infrared cut filter, a dichroic filter, an interference filter, and a color temperature conversion filter.

The irradiation can be performed by, for example, imagewise irradiating the surface of the electrostatic latent image bearer to light using the irradiation member.

In the present invention, light may be imagewise applied from the backside of the electrostatic latent image bearer.

<Developing Unit>

The developing unit is not particularly limited and may be appropriately selected depending on the intended purpose so long as it is a developing unit containing a toner for developing the electrostatic latent image formed on the electrostatic latent image bearer to thereby form a visible image.

The developing unit is preferably a developing device containing: a stirring device for charging the toner with friction generated during stirring; a magnetic field-generating unit fixed inside; and a developer bearing member to bear a developer containing the toner on a surface thereof and to be rotatable.

<Other Units>

Examples of the other units include a transfer unit, a fixing unit, a cleaning unit, a charge-eliminating unit, a recycling unit, and a controlling unit.

—Transfer Unit—

The transfer unit is not particularly limited and may be appropriately selected depending on the intended purpose so long as it is a unit to transfer the visible image onto a recording medium. Preferably, the transfer unit includes: a primary transfer unit to transfer the visible images to an intermediate transfer member to form a composite transfer image; and a secondary transfer unit to transfer the composite transfer image onto a recording medium.

Here, when the image to be secondarily transferred onto the recording medium is a color image of several color toners, a configuration can be employed in which the transfer unit sequentially superposes the color toners on top of another on the intermediate transfer member to form an image on the intermediate transfer member, and the image on the intermediate transfer member is secondarily transferred at one time onto the recording medium by the intermediate transfer unit.

The intermediate transfer member is not particularly limited and may be appropriately selected from known transfer members depending on the intended purpose. For example, the intermediate transfer member is preferably a transferring belt.

The transfer unit (including the primary- and secondary transfer units) preferably includes at least a transfer device which transfers the visible images from the photoconductor onto the recording medium. Examples of the transfer device include a corona transfer device employing corona discharge, a transfer belt, a transfer roller, a pressing transfer roller and an adhesive transferring device.

The recording medium is not particularly limited and may be appropriately selected depending on the purpose, so long as it can receive a developed, unfixed image. Examples of the recording medium include plain paper and a PET base for OHP, with plain paper being used typically.

—Fixing Unit—

The fixing unit is not particularly limited and may be appropriately selected depending on the intended purpose as long as it is a unit to fix a transferred image which has been transferred on the recording medium, but is preferably known heating-pressurizing members. Examples thereof include a combination of a heat roller and a press roller, and a combination of a heat roller, a press roller and an endless belt.

The fixing step is not particularly limited and may be appropriately selected depending on the intended purpose, as long as it is a step of fixing a visible image which has been transferred on the recording medium. The fixing step may be performed every time when an image of each color toner is transferred onto the recording medium, or at one time (at the same time) on a laminated image of color toners.

The fixing step can be performed by the fixing unit.

The heating-pressurizing member usually performs heating preferably at 80° C. to 200° C.

Notably, in the present invention, known photofixing devices may be used instead of or in addition to the fixing unit depending on the intended purpose.

A surface pressure at the fixing step is not particularly limited and may be appropriately selected depending on the intended purpose, but is preferably 10 $N/cm^2$ to 80 $N/cm^2$.

—Cleaning Unit—

The cleaning unit is not particularly limited and may be appropriately selected depending on the intended purpose, as long as it can remove the toner remaining on the photoconductor. Examples thereof include a magnetic brush cleaner, an electrostatic brush cleaner, a magnetic roller cleaner, a blade cleaner, a brush cleaner and a web cleaner.

—Charge-Eliminating Unit—

The charge-eliminating unit is not particularly limited and may be appropriately selected depending on the intended purpose, as long as it is a unit to apply a charge-eliminating bias to the photoconductor to thereby charge-eliminate. Examples thereof include a charge-eliminating lamp.

—Recycling Unit—

The recycling unit is not particularly limited and may be appropriately selected depending on the intended purpose, as long as it is a unit to recycle the toner which has been removed at the cleaning step to the developing device. Example thereof includes a known conveying unit.

An embodiment of method of forming an image using an image forming apparatus of the present invention will be explained with reference to FIG. 4.

An image forming apparatus 1 is a printer. The image forming apparatus is not particularly limited if it is capable of forming images with a toner, such as copiers, facsimiles and multifunctional machines.

The image forming apparatus 1 includes a paper feeder 210, a conveyor 220, an image former 230, a transferer 240 and a fixer 250.

The paper feeder 210 includes a paper feed cassette 211 papers P to be fed are loaded and a paper feed roller 212 feeding one piece by one of the papers P loaded in the paper feed cassette 211.

The conveyor 220 includes a roller 221 conveying the paper P fed by the paper feed roller 212 in the direction of the transferer 240, a timing roller 222 waiting while pinching an end of the paper P fed by the roller 221 and feeding the paper to the transferer 240 at a predetermined timing, and a paper discharge roller 223 discharging the paper P a color toner image is fixed on onto a paper discharge tray 224.

Figure 4:
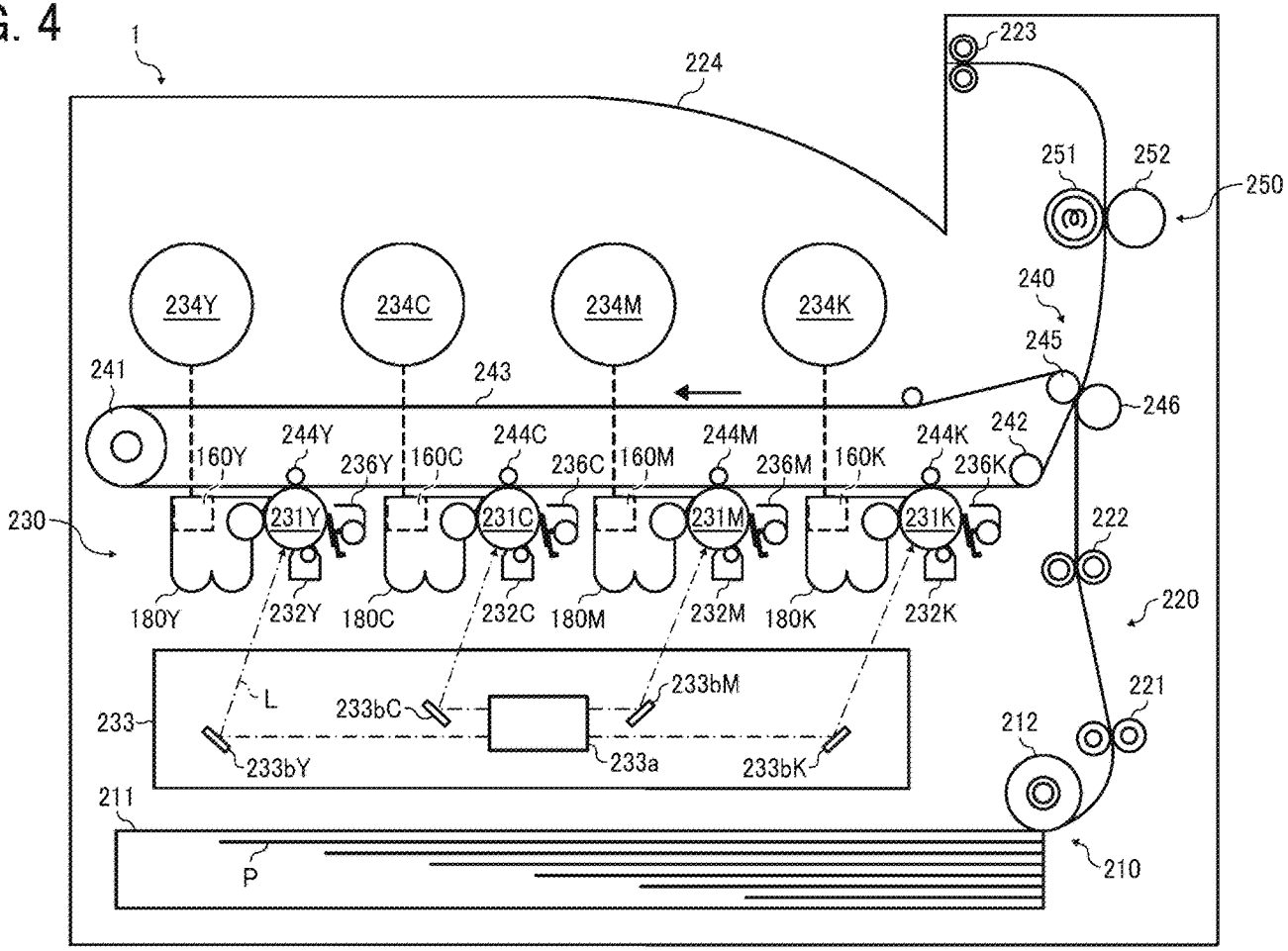
FIG. 4 is a schematic view illustrating an embodiment of the image forming apparatus of the present invention.

The image former 230 includes an image forming unit Y using a developer having a yellow toner, an image forming unit C using a developer having a cyan toner, an image forming unit M using a developer having a magenta toner and an image forming unit K using a developer having a black toner in this order from left to right at a predetermined interval in FIG. 4, and an irradiator 233.

An arbitrary image forming unit among the image forming units Y to K is simply referred to as the image forming unit.

The developer includes a toner and a carrier.

The four image forming units Y to K only use developers different from each other and substantially have the same mechanical constitutions.

The transferer 240 includes a drive roller 241, a driven roller 242, an intermediate transfer belt 243 rotatable anticlockwise as the drive roller 241 drives, first transfer rollers 244Y, 244C, 244M and 244K facing a photoconductor drum 231 through the intermediate transfer belt 243, and a second facing roller 245 and a second transfer roller 246 opposite to each other through the intermediate transfer belt 243 at a transfer position where a toner image is transferred to a paper.

The fixer 250 includes a heater inside, and a fixing belt 251 heating a paper P and a pressure roller 252 rotatably pressuring the fixing belt 251 to form a nip, which applies heat and pressure to a toner image on the paper P to be fixed thereon. The paper P the color toner image is fixed on is discharged by the paper discharge roller 223 onto the paper discharge tray 224.

<Process Cartridge>

A process cartridge of the present invention is molded so as to be mounted to various image forming apparatuses in an attachable and detachable manner, including at least an electrostatic latent image bearer configured to bear an electrostatic latent image; and a developing unit configured to form a toner image by developing the electrostatic latent image born on the electrostatic latent image bearer with a developer of the present invention. Note that, the process cartridge of the present invention may further include other units, if necessary.

The developing unit includes a developer accommodating container configured to accommodate the developer of the present invention, and a developer bearing member configured to bear and convey the developer accommodated in the developer accommodating container. Note that, the developing unit further includes a regulating member, and the like, in order to regulate a thickness of the developer born.

Figure 5:
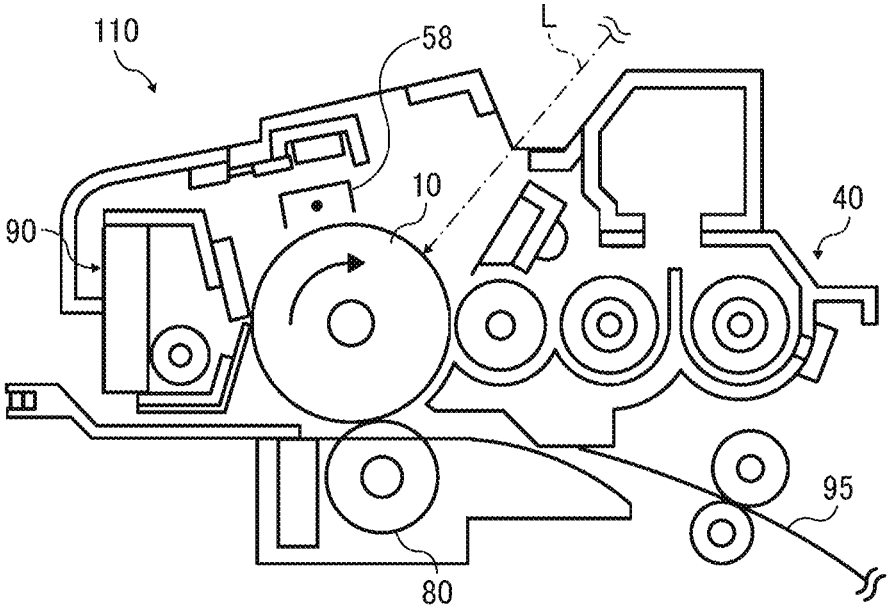
FIG. 5 is a schematic view illustrating an embodiment of a process cartridge.

FIG. 5 illustrates one example of a process cartridge of the present invention. A process cartridge 110 includes a photoconductor drum 10, a corona charging device 58, a developing device 40, a transfer roller 80, and a cleaning device 90.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts or %, unless otherwise specified.

<Synthesis of Amorphous Polyester Resin A1>

A four-necked flask equipped with a nitrogen-introducing tube, a dehydration tube, a stirring device, and a thermocouple was charged with bisphenol A ethylene oxide 2 mole adduct BisA-EO), bisphenol A propylene oxide 3 mole adduct (BisA-PO), trimethylol propane (TMP), terephthalic acid, and adipic acid so that a ratio by mole of bisphenol A ethylene oxide 2 mole adduct to bisphenol A propylene oxide 3 mole adduct to trimethylol propane (bisphenol A ethylene oxide 2 mole adduct/bisphenol A propylene oxide 3 mole adduct/trimethylol propane) was set to 38.6/57.9/3.5, a ratio by mole of terephthalic acid to adipic acid (isophthalic acid/adipic acid) was set to 85/15, and a ratio by mole of hydroxyl group to carboxyl group OH/COOH was 1.2. Moreover, titanium tetraisopropoxide (500 ppm relative to the resin component) was added thereto and the resultant mixture was allowed to react under normal pressure at 230° C. for 8 hrs and then to further react under a reduced pressure of 10 mmHg to 15 mmHg for 4 hrs. Then, trimellitic anhydride was added to the vessel so that an amount thereof was 1 mol % relative to the total resin component, followed by reacting at 180° C. under normal pressure for 3 hrs, to thereby obtain an amorphous polyester resin A1.

<Synthesis of Amorphous Polyester Resin A2>

A four-necked flask equipped with a nitrogen-introducing tube, a dehydration tube, a stirring device, and a thermocouple was charged with bisphenol A ethylene oxide 2 mole adduct BisA-EO), bisphenol A propylene oxide 3 mole adduct (BisA-PO), trimethylol propane (TMP), terephthalic acid, and adipic acid so that a ratio by mole of bisphenol A ethylene oxide 2 mole adduct to bisphenol A propylene oxide 3 mole adduct to trimethylol propane (bisphenol A ethylene oxide 2 mole adduct/bisphenol A propylene oxide 3 mole adduct/trimethylol propane) was set to 38.6/57.9/3.5, a ratio by mole of terephthalic acid to adipic acid (isophthalic acid/adipic acid) was set to 85/15, and a ratio by mole of hydroxyl group to carboxyl group OH/COOH was 1.2. Moreover, titanium tetraisopropoxide (500 ppm relative to the resin component) was added thereto and the resultant mixture was allowed to react under normal pressure at 230° C. for 8 hrs and then to further react under a reduced pressure of 10 mmHg to 15 mmHg for 4 hrs. Then, trimellitic anhydride was added to the vessel so that an amount thereof was 3 mol % relative to the total resin component, followed by reacting at 180° C. under normal pressure for 3 hrs, to thereby obtain an amorphous polyester resin A2.

<Synthesis of Amorphous Polyester Resin A3>

A four-necked flask equipped with a nitrogen-introducing tube, a dehydration tube, a stirring device, and a thermocouple was charged with bisphenol A ethylene oxide 2 mole adduct BisA-EO), bisphenol A propylene oxide 3 mole adduct (BisA-PO), trimethylol propane (TMP), terephthalic acid, and adipic acid so that a ratio by mole of bisphenol A ethylene oxide 2 mole adduct to bisphenol A propylene oxide 3 mole adduct to trimethylol propane (bisphenol A ethylene oxide 2 mole adduct/bisphenol A propylene oxide 3 mole adduct/trimethylol propane) was set to 38.6/57.9/3.5, a ratio by mole of terephthalic acid to adipic acid (isophthalic acid/adipic acid) was set to 85/15, and a ratio by mole of hydroxyl group to carboxyl group OH/COOH was 1.2. Moreover, titanium tetraisopropoxide (500 ppm relative to the resin component) was added thereto and the resultant mixture was allowed to react under normal pressure at 230° C. for 8 hrs and then to further react under a reduced pressure of 10 mmHg to 15 mmHg for 4 hrs. Then, trimellitic anhydride was added to the vessel so that an amount thereof was 0.25 mol % relative to the total resin component, followed by reacting at 180° C. under normal pressure for 3 hrs, to thereby obtain an amorphous polyester resin A3.

<Synthesis of Prepolymer B>

A reaction vessel equipped with a condenser, a stirring device, and a nitrogen-introducing tube was charged with 97% by mol of 3-methyl-1,5-pentanediol and 3% by mol of trimethylol propane (TMP) as alcoholic components, and 100% by mol of adipic acid and 50% by mol of terephthalic acid as acidic components so that OH/COOH was 1.1 together with titanium tetraisopropoxide (300 ppm relative to the resin component). Thereafter, the resultant mixture was heated to 200° C. for about 4 hours, then was heated to 230° C. for 2 hrs, and was allowed to react until no flowing water was formed. Thereafter, the reaction mixture was allowed to further react for 5 hrs under a reduced pressure of 10 mmHg to 15 mmHg, to thereby obtain an intermediate polyester B-1.

Next, a reaction vessel equipped with a condenser, a stirring device, and a nitrogen-introducing tube was charged with the intermediate polyester B-1 solution and isophorone diisocyanate (IPDI) at a ratio by mole (isocyanate group of IPDI/hydroxyl group of the intermediate polyester) of 2.1. The resultant mixture was diluted with ethyl acetate so as to be a 48% ethyl acetate solution, followed by reacting at 100° C. for 5 hrs, to thereby obtain a nonlinear polyester resin B [prepolymer B] having a reactive group.

<Synthesis of Crystalline Polyester Resin C>

A four-necked flask of 5 L equipped with a nitrogen-introducing tube, a dehydration tube, a stirring device, and a thermocouple was charged with sebacic acid and 1,6-hexanediol so that a ratio by mole of hydroxyl group to carboxyl group OH/COOH was 0.9 together with titanium tetraisopropoxide (500 ppm relative to the resin component) was added thereto, and the resultant mixture was allowed to react at 180° C. for 10 hrs, heated to 200° C., allowed to react 3 hrs, and then to further react under a pressure of 8.3 kPa for 2 hrs to thereby obtain a crystalline polyester resin C.

Properties of the obtained polyester resins are shown in Table 1.

TABLE 1

| | Melting Point (° C.) | Tg (° C.) | Mw | Acid Value | Hydroxyl Value |
|---|---|---|---|---|---|
| Resin A1 | — | 57.4 | 9800 | 20.0 | 26.7 |
| Resin A2 | — | 61.0 | 10500 | 60.1 | 27.2 |
| Resin A3 | — | 56.5 | 9900 | 5.2 | 26.2 |
| Resin B | — | −38.9 | 11600 | 0.14 | 24.8 |
| Resin C | | — | 22000 | 8.7 | 7.6 |

(Slurry Liquid of Toner 1)

<Preparation of Masterbatch (MB)>

Water (600), 500 parts of carbon black (NIPEX 60 from Degussa) and 500 parts of the [amorphous polyester resin A1] were added and mixed together by HENSCHEL MIXER (product of NIPPON COKE & ENGINEERING CO., LTD.), and the resultant mixture was kneaded by a two roll mill for 30 min at 150° C. The kneaded product was rolled out and cooled, followed by pulverizing by a pulverizer, to thereby obtain [masterbatch 1].

<Synthesis of Organic Fine Particle Emulsion (Fine Particle Dispersion)>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 138 parts of styrene, 138 parts of methacrylic acid, and 1 part of ammonium persulfate, and the resultant mixture was stirred for 15 min at 400 rpm, to thereby obtain a white emulsion. The obtained emulsion was heated to have the system temperature of 75° C., and then was allowed to react for 5 hrs. To the resultant mixture, 30 parts of a 1% ammonium persulfate aqueous solution was added, followed by aging for 5 hrs at 75° C., to thereby obtain an aqueous dispersion of a vinyl resin (a copolymer of styrene/methacrylic acid/sodium salt of sulfuric acid ester of methacrylic acid ethylene oxide adduct), i.e., a [fine particle dispersion].

The [fine particle dispersion] was measured by LA-920 (product of HORIBA, Ltd.), and as a result, a volume-average particle diameter thereof was found to be 0.14 μm.

<Preparation of Aqueous Phase>

Water (2,240 parts), 80 parts of the [fine particle dispersion], 80 parts of a 48.5% aqueous solution of sodium dodecyl diphenyl ether disulfonate (ELEMINOL MON-7, product of Sanyo Chemical Industries Ltd.), and 200 parts of ethyl acetate were mixed and stirred, to thereby obtain an opaque white liquid. The obtained liquid was used as [aqueous phase].

<Preparation of WAX Dispersion>

A vessel to which a stirring bar and a thermometer had been set was charged with 100 parts of ester wax WEP-3 having a melting point of 70° C. and an acid value of 0.1 mg KOH/g from NOF Corp. as release agent, and 400 parts of ethyl acetate, followed by heating to 80° C. during stirring. The temperature was maintained at 80° C. for 5 hrs, and then the mixture was cooled to 20° C. in 1 hr. The resultant mixture was dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to thereby obtain a [WAX dispersion 1].

<Preparation of Crystalline Polyester Resin C Dispersion>

A vessel to which a stirring bar and a thermometer had been set was charged with 100 parts of the crystalline polyester resin C and 400 parts of ethyl acetate, followed by heating to 80° C. during stirring. The temperature was maintained at 80° C. for 5 hrs, followed by cooling to 20° C. in 1 hr. The resultant mixture was dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes, to thereby obtain a [crystalline polyester resin C dispersion].

<Preparation of Oil Phase>

A vessel was charged with 302 parts of ethyl acetate, 250 parts of the [WAX dispersion 1], 500 parts of the crystalline polyester resin C dispersion], 650 parts of the [amorphous polyester resin A1] and 100 parts of the [masterbatch 11], followed by mixing using a TK Homomixer (product of PRIMIX Corp.) at 5,000 rpm for 60 min. Then, 300 parts of ethyl acetate solution of the [prepolymer B] and 2 parts of isophorone diamine were added to the mixture, followed by mixing using a TK Homomixer (product of PRIMIX Corp.) at 5,000 rpm for 1 min, to thereby obtain an [oil phase].

<Emulsification • Removal of Solvent>

A container including 2,600 parts of the [aqueous phase] was charged with the [oil phase], and the resultant mixture was mixed by a TK Homomixer at 13,000 rpm for 3 min, to thereby obtain an [emulsified slurry] having a volume-average particle diameter of 5.5 μm after the solvent was removed.

A container equipped with a stirrer and a thermometer was charged with the [emulsified slurry], followed by removing the solvent therein at 30° C. for 8 hrs, and aging at 45° C. for 4 hrs, to thereby obtain a [dispersion slurry].

<Washing • Drying>

After subjecting 100 parts of the [dispersion slurry 1] to filtration under a reduced pressure, the obtained cake was subjected twice to a series of treatments (1) to (4) described below, to thereby produce [filtration cake].

(1): ion-exchanged water (100 parts) was added to the filtration cake, followed by mixing with a TK Homomixer (at 12,000 rpm for 10 min), and then the mixture was filtrated;

(2): one hundred (100) parts of 10% aqueous sodium hydroxide solution was added to the filtration cake obtained in (I), followed by mixing with a TK Homomixer (at 12,000 rpm for 30 min), and then the resultant mixture was filtrated under a reduced pressure;

(3): one hundred (100) parts of 10% by weight hydrochloric acid was added to the filtration cake obtained in (2), followed by mixing with a TK Homomixer (at 12,000 rpm for 10 min) and then the mixture was filtrated; and (4): ion-exchanged water (300 parts) was added to the filtration cake obtained in (3), followed by mixing with a TK Homomixer (at 12,000 rpm for 10 min) and then the mixture was filtrated. The above steps (1) to (4) were repeated twice to prepare a filtration cake. Further, ion-exchanged water was added to the filtration cake to include solid contents of 50%, followed by mixing with a TK Homomixer (at 12,000 rpm for 10 min) to obtain a "slurry liquid of toner 1".

(Synthesis of Zirconium Compound)

<Zirconium Complex or Salt of Salicylic Acid Derivative>

Three hundred twenty two point three (322.3) g of oxy zirconium chloride (8 hydrates) were dissolved in 9,677.7 g of ion-exchanged water to prepare an aqueous solution of 0.1 mmol/g. Five hundred point seven (500.7) g of 3,5-di-t-butyl salicylic acid were dissolved in 7,999.4 g of 1% caustic soda water and 1,535.9 g of ion-exchanged water to prepare 0.1 mmol/g of a basic aqueous solution. The caustic soda aqueous solution of the 3, 5-di-t-butyl salicylic acid was gradually added to the aqueous solution of the zirconium chloride while stirred to synthesize a zirconium compound A. The zirconium compound A was filtered, repeatedly re-dispersed in ion-exchanged water and washed to obtain a filtration cake. The filtration cake was dried at 45° C. for 48 hrs by a circulation air dryer.

One hundred (100) parts of the washed and dried zirconium compound A, 899 parts of ion-exchanged water, 1 parts of 48.5% aqueous solution of sodium dodecyl diphenyl ether disulfonate (ELEMINOL MON-7, product of Sanyo Chemical Industries Ltd.) were mixed and dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 10 passes, to thereby obtain a [dispersion of zirconium compound A (1)].

The dispersion was measured by LA-920 (product of HORIBA, Ltd.), and as a result, a volume-average particle diameter thereof was found to be 0.25 μm.

The dispersion conditions were changed to 7, 6, 3 and 2 passes to obtain [dispersions of zirconium compound A (2) to (5)], respectively.

The dispersions were measured by LA-920 (product of HORIBA, Ltd.), and as a result, a volume-average particle diameters thereof were found to be 0.39, 0.51, 0.99 and 1.24 μm, respectively <Zirconium Complex or Salt of Hydroxy Naphthaic Acid Derivative>

Three hundred twenty two point three (322.3) g of oxy zirconium chloride (8 hydrates) were dissolved in 9,677.7 g of ion-exchanged water to prepare an aqueous solution of 0.1 mmol/g. Three hundred seventy six point four (376.4) g of 3-hydroxy-2-naphthaic acid were dissolved in 7,999.4 g of 1% caustic soda water and 1,535.9 g of ion-exchanged water to prepare 0.1 mmol/g of a basic aqueous solution. The caustic soda aqueous solution of the 3-hydroxy-2-naphthaic acid was gradually added to the aqueous solution of the zirconium chloride while stirred to synthesize a zirconium compound B. The zirconium compound B was filtered, repeatedly re-dispersed in ion-exchanged water and washed to obtain a filtration cake. The filtration cake was dried at 45° C. for 48 hrs by a circulation air dryer.

One hundred (100) parts of the washed and dried zirconium compound B, 899 parts of ion-exchanged water, 1 parts of 48.5% aqueous solution of sodium dodecyl diphenyl ether disulfonate (ELEMINOL MON-7, product of Sanyo Chemical Industries Ltd.) were mixed and dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 7 passes, to thereby obtain a [dispersion of zirconium compound B].

The dispersion was measured by LA-920 (product of HORIBA, Ltd.), and as a result, a volume-average particle diameter thereof was found to be 0.40 μm.

(Synthesis of Iron (III) Compound)

<Iron Complex or Salt of Salicylic Acid Derivative>

Two hundred seventy point three (270.3) g of iron chloride (6 hydrates) were dissolved in 9,729.7 g of ion-exchanged water to prepare an aqueous solution of 0.1 mmol/g. Five hundred point seven (500.7) g of 3,5-di-t-butyl salicylic acid were dissolved in 7,999.4 g of 1% caustic soda water and 1,535.9 g of ion-exchanged water to prepare 0.1 mmol/g of a basic aqueous solution. The caustic soda aqueous solution of the 3,5-di-t-butyl salicylic acid was gradually added to the aqueous solution of the iron chloride while stirred to synthesize an iron (III) compound C. The iron (III) compound C was filtered, repeatedly re-dispersed in ion-exchanged water and washed to obtain a filtration cake. The filtration cake was dried at 45° C. for 48 hrs by a circulation air dryer.

One hundred (100) parts of the washed and dried iron (III) compound C, 899 parts of ion-exchanged water, 1 parts of 48.5% aqueous solution of sodium dodecyl diphenyl ether disulfonate (ELEMINOL MON-7, product of Sanyo Chemical Industries Ltd.) were mixed and dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 7 passes, to thereby obtain a [dispersion of iron (III) compound C].

The dispersion was measured by LA-920 (product of HORIBA, Ltd.), and as a result, a volume-average particle diameter thereof was found to be 0.38 μm.

(Synthesis of Chrome Compound)

<Chrome Complex or Salt of Salicylic Acid Derivative>

Two hundred sixty six point five (266.5) g of chrome chloride (6 hydrates) were dissolved in 9,733.5 g of ion-exchanged water to prepare an aqueous solution of 0.1 mmol/g. Five hundred point seven (500.7) g of 3,5-di-t-butyl salicylic acid were dissolved in 7,999.4 g of 1% caustic soda water and 1,535.9 g of ion-exchanged water to prepare 0.1 mmol/g of a basic aqueous solution. The caustic soda aqueous solution of the 3,5-di-t-butyl salicylic acid was gradually added to the aqueous solution of the chrome chloride while stirred to synthesize a chrome compound D. The chrome compound D was filtered, repeatedly re-dispersed in ion-exchanged water and washed to obtain a filtration cake. The filtration cake was dried at 45° C. for 48 hrs by a circulation air dryer.

One hundred (100) parts of the washed and dried chrome compound D, 899 parts of ion-exchanged water, 1 parts of 48.5% aqueous solution of sodium dodecyl diphenyl ether disulfonate (ELEMINOL MON-7, product of Sanyo Chemical Industries Ltd.) were mixed and dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 7 passes, to thereby obtain a [dispersion of chrome compound D].

The dispersion was measured by LA-920 (product of HORIBA, Ltd.), and as a result, a volume-average particle diameter thereof was found to be 0.40 μm.

(Synthesis of Aluminum Compound)

<Aluminum Complex or Salt of Salicylic Acid Derivative>

Two hundred forty one point four (241.4) g of aluminum chloride (6 hydrates) were dissolved in 9,758.6 g of ion-exchanged water to prepare an aqueous solution of 0.1 mmol/g. Five hundred point seven (500.7) g of 3,5-di-t-butyl salicylic acid were dissolved in 7,999.4 g of 1% caustic soda water and 1,535.9 g of ion-exchanged water to prepare 0.1 mmol/g of a basic aqueous solution. The caustic soda aqueous solution of the 3,5-di-t-butyl salicylic acid was gradually added to the aqueous solution of the aluminum chloride while stirred to synthesize an aluminum compound E. The aluminum compound E was filtered, repeatedly re-dispersed in ion-exchanged water and washed to obtain a filtration cake. The filtration cake was dried at 45° C. for 48 hrs by a circulation air dryer.

One hundred (100) parts of the washed and dried aluminum compound E, 899 parts of ion-exchanged water, 1 parts of 48.5% aqueous solution of sodium dodecyl diphenyl ether disulfonate (ELEMINOL MON-7, product of Sanyo Chemical Industries Ltd.) were mixed and dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 7 passes, to thereby obtain a [dispersion of aluminum compound E].

The dispersion was measured by LA-920 (product of HORIBA, Ltd.), and as a result, a volume-average particle diameter thereof was found to be 0.39 μm.

(Synthesis of Zinc Compound)

<Zinc Complex or Salt of Salicylic Acid Derivative>

One hundred thirty six point three (136.3) g of zinc chloride were dissolved in 9,863.7 g of ion-exchanged water to prepare an aqueous solution of 0.1 mmol/g. Five hundred point seven (500.7) g of 3,5-di-t-butyl salicylic acid were dissolved in 7,999.4 g of 1% caustic soda water and 1,535.9 g of ion-exchanged water to prepare 0.1 mmol/g of a basic aqueous solution. The caustic soda aqueous solution of the 3,5-di-t-butyl salicylic acid was gradually added to the aqueous solution of the zinc chloride while stirred to synthesize a zinc compound F. The zinc compound F was filtered, repeatedly re-dispersed in ion-exchanged water and washed to obtain a filtration cake. The filtration cake was dried at 45° C. for 48 hrs by a circulation air dryer.

One hundred (100) parts of the washed and dried zinc compound F, 899 parts of ion-exchanged water, 1 parts of 48.5% aqueous solution of sodium dodecyl diphenyl ether disulfonate (ELEMINOL MON-7, product of Sanyo Chemical Industries Ltd.) were mixed and dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 7 passes, to thereby obtain a [dispersion of zinc compound F].

The dispersion was measured by LA-920 (product of HORIBA, Ltd.), and as a result, a volume-average particle diameter thereof was found to be 0.37 μm.

Example 1

Two hundred (200) parts of the "slurry liquid of toner 1" processed to have solid contents of 25% by mass and 6.3 parts of the [dispersion of zirconium compound A (1)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 1]. One hundred (100) parts of the [toner base particle 1] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 1].

Example 2

Two hundred (200) parts of the "slurry liquid of toner 1" processed to have solid contents of 25% by mass and 25.0 parts of the [dispersion of zirconium compound A (4)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 2]. One hundred (100) parts of the [toner base particle 2] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 2].

Example 3

Two hundred (200) parts of the "slurry liquid of toner 1" processed to have solid contents of 25% by mass and 5.0 parts of the [dispersion of zirconium compound A (2)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 3]. One hundred (100) parts of the [toner base particle 3] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 3].

Example 4

Two hundred (200) parts of the "slurry liquid of toner 1" processed to have solid contents of 25% by mass and 10.0 parts of the [dispersion of zirconium compound A (2)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 4]. One hundred (100) parts of the [toner base particle 4] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 4].

(Slurry Liquid of Toner 5)

The procedure for preparation of the slurry liquid of toner 1 was repeated except for having a volume-average particle diameter of 7.0 μm after the solvent was removed to prepare a slurry liquid of toner 5.

Example 5

Two hundred (200) parts of the "slurry liquid of toner 5" processed to have solid contents of 25% by mass and 7.9 parts of the [dispersion of zirconium compound A (2)] were mixed. One (1)% by mass hydrochloric acid as an aggregating agent was gradually added to the mixture to have a pH of 2, and the zirconium compound A was aggregated on the toner 5. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 5]. One hundred (100) parts of the [toner base particle 5] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 5].

Example 6

Two hundred (200) parts of the "slurry liquid of toner 1" processed to have solid contents of 25% by mass and 10.0 parts of the [dispersion of zirconium compound B] were mixed. One (1)% by mass hydrochloric acid as an aggregating agent was gradually added to the mixture to have a pH of 2, and the zirconium compound B was aggregated on the toner 1. The resultant liquid was held for 1 hr at 50° C. to fix the zirconium compound B on the surface of the toner. The liquid was filtered and dried with an air-circulating drier at 45° C. for 48 hrs, and then was caused to pass through a sieve with a mesh size of 75 μm, to thereby obtain a [toner base particle 6]. One hundred (100) parts of the [toner base particle 6] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 6].

Example 7

Two hundred (200) parts of the "slurry liquid of toner 1" processed to have solid contents of 25% by mass and 8.7 parts of the [dispersion of aluminum compound E] were mixed. One (1)% by mass hydrochloric acid as an aggregating agent was gradually added to the mixture to have a pH of 2, and the aluminum compound E was aggregated on the toner 1. The resultant liquid was held for 1 hr at 50° C. to fix the aluminum compound E on the surface of the toner. The liquid was filtered and dried with an air-circulating drier at 45° C. for 48 hrs, and then was caused to pass through a sieve with a mesh size of 75 μm, to thereby obtain a [toner base particle 7]. One hundred (100) parts of the [toner base particle 7] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 7].

Example 8

Two hundred (200) parts of the "slurry liquid of toner 1" processed to have solid contents of 25% by mass and 9.1 parts of the [dispersion of chrome compound D] were mixed. One (1)% by mass hydrochloric acid as an aggregating agent was gradually added to the mixture to have a pH of 2, and the chrome compound D was aggregated on the toner 1. The resultant liquid was held for 1 hr at 50° C. to fix the chrome compound D on the surface of the toner. The liquid was filtered and dried with an air-circulating drier at 45° C. for 48 hrs, and then was caused to pass through a sieve with a mesh size of 75 μm, to thereby obtain a [toner base particle 8]. One hundred (100) parts of the [toner base particle 8] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 8].

Example 9

Two hundred (200) parts of the "slurry liquid of toner 1" processed to have solid contents of 25% by mass and 9.1 parts of the [dispersion of iron (III) compound C] were mixed. One (1)% by mass hydrochloric acid as an aggregating agent was gradually added to the mixture to have a pH of 2, and the iron (III) compound C was aggregated on the toner 1. The resultant liquid was held for 1 hr at 50° C. to fix the iron (III) compound C on the surface of the toner. The liquid was filtered and dried with an air-circulating drier at 45° C. for 48 hrs, and then was caused to pass through a sieve with a mesh size of 75 μm, to thereby obtain a [toner base particle 9]. One hundred (100) parts of the [toner base particle 9] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 9].

Example 10

Two hundred (200) parts of the "slurry liquid of toner 1" processed to have solid contents of 25% by mass and 9.3 parts of the [dispersion of zinc compound F] were mixed. One (1)% by mass hydrochloric acid as an aggregating agent was gradually added to the mixture to have a pH of 2, and the zinc compound F was aggregated on the toner 1. The resultant liquid was held for 1 hr at 50° C. to fix the zinc compound F on the surface of the toner. The liquid was filtered and dried with an air-circulating drier at 45° C. for 48 hrs, and then was caused to pass through a sieve with a mesh size of 75 μm, to thereby obtain a [toner base particle 10]. One hundred (100) parts of the [toner base particle 10] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 10].

Example 11

Two hundred (200) parts of the "slurry liquid of toner 1" processed to have solid contents of 25% by mass and 20.0 parts of the [dispersion of zirconium compound A (2)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 11]. One hundred (100) parts of the [toner base particle 11] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 11].

(Slurry Liquids of Toners 12 to 15)

The procedure for preparation of the slurry liquid of toner 1 was repeated except for changing the mixing ratio of the amorphous polyester A1 to A3 as shown in Table 2 to prepare slurry liquids of toners 12 to 15.

TABLE 2

| | A1 [part] | A2 [part] | A3 [part] |
|---|---|---|---|
| Slurry Liquid of Toner 12 | 214.5 | 0 | 435.5 |
| Slurry Liquid of Toner 13 | 162.5 | 487.5 | 0 |

TABLE 2-continued

| | A1 [part] | A2 [part] | A3 [part] |
|---|---|---|---|
| Slurry Liquid of Toner 14 | 130 | 0 | 520 |
| Slurry Liquid of Toner 15 | 130 | 520 | 0 |

Example 12

Two hundred (200) parts of the "slurry liquid of toner 12" processed to have solid contents of 25% by mass and 10.0 parts of the [dispersion of zirconium compound A (2)] were mixed. One (1)% by mass hydrochloric acid as an aggregating agent was gradually added to the mixture to have a pH of 2, and the zirconium compound A was aggregated on the toner 12. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 12]. One hundred (100) parts of the [toner base particle 12] were mixed with 1.0 part of NX-90S from Nippon Aerosil Co., Ltd., 1.0 part of JMT-1501B from Tayca Corp. and 1.0 part of the HSP-160A from Fuso Chemical Co., Ltd. by a Henschel mixer, and passed through a sift having a mesh size of 25 μm to thereby obtain a [toner of Example 12].

Example 13

Two hundred (200) parts of the "slurry liquid of toner 13" processed to have solid contents of 25% by mass and 10.0 parts of the [dispersion of zirconium compound A (2)] were mixed. One (1)% by mass hydrochloric acid as an aggregating agent was gradually added to the mixture to have a pH of 2, and the zirconium compound A was aggregated on the toner 13. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 13]. One hundred (100) parts of the [toner base particle 13] were mixed with 1.0 part of NX-90S from Nippon Aerosil Co., Ltd., 1.0 part of JMT-1501B from Tayca Corp. and 1.0 part of the HSP-160A from Fuso Chemical Co., Ltd. by a Henschel mixer, and passed through a sift having a mesh size of 25 μm to thereby obtain a [toner of Example 13].

Example 14

Two hundred (200) parts of the "slurry liquid of toner 14" processed to have solid contents of 25% by mass and 10.0 parts of the [dispersion of zirconium compound A (2)] were mixed. One (1)% by mass hydrochloric acid as an aggregating agent was gradually added to the mixture to have a pH of 2, and the zirconium compound A was aggregated on the toner 14. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 14]. One hundred (100) parts of the [toner base particle 14] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 14].

Example 15

Two hundred (200) parts of the "slurry liquid of toner 15" processed to have solid contents of 25% by mass and 10.0 parts of the [dispersion of zirconium compound A (2)] were mixed. One (1)% by mass hydrochloric acid as an aggregating agent was gradually added to the mixture to have a pH of 2, and the zirconium compound A was aggregated on the toner 15. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 15]. One hundred (100) parts of the [toner base particle 15] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 15].

Example 16

Two hundred (200) parts of the "slurry liquid of toner 1" processed to have solid contents of 25% by mass and 12.5 parts of the [dispersion of zirconium compound A (3)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 16]. One hundred (100) parts of the [toner base particle 16] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 16].

Example 17

Two hundred (200) parts of the "slurry liquid of toner 1" processed to have solid contents of 25% by mass and 22.5 parts of the [dispersion of zirconium compound A (2)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 17]. One hundred (100) parts of the [toner base particle 17] were mixed with 1.0 part of NX-90S from Nippon Aerosil Co., Ltd., 1.0 part of JMT-1501B from Tayca Corp. and 1.0 part of the HSP-160A from Fuso Chemical Co., Ltd. by a Henschel mixer, and passed through a sift having a mesh size of 25 μm to thereby obtain a [toner of Example 17].

Example 18

Two hundred (200) parts of the "slurry liquid of toner 1" processed to have solid contents of 25% by mass and 28.1 parts of the [dispersion of zirconium compound A (3)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 18]. One hundred (100) parts of the [toner base particle 18] were mixed with 1.0 part of NX-90S from Nippon Aerosil Co., Ltd., 1.0 part of JMT-1501B from Tayca Corp. and 1.0 part of the HSP-160A from Fuso Chemical Co., Ltd. by a Henschel mixer, and passed through a sift having a mesh size of 25 μm to thereby obtain a [toner of Example 18].

<Preparation of Ethyl Acetate Dispersion of Salicylic Acid Derivative Metal Salt>

A vessel equipped with a stirring bar and a thermometer was charged with 50 parts of 3,5-di-t-zirconium butyl salicylate (SZr), 50 parts of amorphous polyester resin A1 and 400 parts of ethyl acetate.

These were heated to have a temperature of 30° C., and held for 1 hr at 30° C. to dissolve the resin and obtain a dispersion of salicylic acid derivative metal salt. The dispersion was cooled to 20° C. in 1 hr and dispersed by a beads mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 7 passes, and ethyl acetate was added thereto, to thereby obtain a [3,5-di-t-zirconium butyl salicylate (SZr) dispersion] processed to have solid contents of 20% by mass. The dispersion was measured by LA-920 (product of HORIBA, Ltd.), and as a result, a volume-average particle diameter thereof was found to be 0.40 μm.

(Slurry Liquid of Toner 19)

The procedure for preparation of the slurry liquid of toner 1 was repeated except for changing the preparation of oil phase as follows to prepare a slurry liquid of toner 19.

<Preparation of Oil Phase>

A vessel was charged with 302 parts of ethyl acetate, 250 parts of the [WAX dispersion 1], 500 parts of the crystalline polyester resin C dispersion], 650 parts of the [amorphous polyester resin A1], 100 parts of the [masterbatch 1] and 279 parts of [(SZr) dispersion], followed by mixing using a TK Homomixer (product of PRIMIX Corp.) at 5,000 rpm for 60 min. Then, 300 parts of [ethyl acetate solution of the amorphous polyester resin A3] and 2 parts of isophorone diamine were added to the mixture, followed by mixing using a TK Homomixer (product of PRIMIX Corp.) at 5,000 rpm for 1 min, to thereby obtain an [oil phase].

Example 19

Two hundred (200) parts of the "slurry liquid of toner 19" processed to have solid contents of 25% by mass and 10.0 parts of the [dispersion of zirconium compound A (2)] were mixed. One (1)% by mass hydrochloric acid as an aggregating agent was gradually added to the mixture to have a pH of 2, and the zirconium compound A was aggregated on the toner 19. The resultant liquid was held for 1 hr at 50° C. to fix the zirconium compound A on the surface of the toner.

The liquid was filtered and dried with an air-circulating drier at 45° C. for 48 hrs, and then was caused to pass through a sieve with a mesh size of 75 μm, to thereby obtain a [toner base particle 19]. One hundred (100) parts of the [toner base particle 19] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Example 19].

Comparative Example 1

The "slurry liquid of toner 1" was filtered and dried with an air-circulating drier at 45° C. for 48 hrs, and then was caused to pass through a sieve with a mesh size of 75 μm, to thereby obtain a [toner base particle 20]. One hundred (100) parts of the [toner base particle 20 ]were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Comparative Example 1].

(Slurry Liquid of Toner 21)

The procedure for preparation of the slurry liquid of toner 1 was repeated except for changing the preparation of oil phase as follows to prepare a slurry liquid of toner 21.

<Preparation of Oil Phase>

A vessel was charged with 302 parts of ethyl acetate, 250 parts of the [WAX dispersion 1], 500 parts of the crystalline polyester resin C dispersion], 650 parts of the [amorphous polyester resin A1], 100 parts of the [masterbatch 1] and 477.7 parts of [(SZr) dispersion], followed by mixing using a TK Homomixer (product of PRIMIX Corp.) at 5,000 rpm for 60 min. Then, 300 parts of [ethyl acetate solution of the amorphous polyester resin A3] and 2 parts of isophorone diamine were added to the mixture, followed by mixing using a TK Homomixer (product of PRIMIX Corp.) at 5,000 rpm for 1 min, to thereby obtain an [oil phase].

Comparative Example 2

The "slurry liquid of toner 21" was filtered and dried with an air-circulating drier at 45° C. for 48 hrs, and then was caused to pass through a sieve with a mesh size of 75 μm, to thereby obtain a [toner base particle 21]. One hundred (100) parts of the [toner base particle 21] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Comparative Example 2].

Comparative Example 3

Zero point forty four (0.44) parts of Fe-salicylic acid derivative complex BONTRON X-11 from ORIENT CHEMICAL INDUSTRIES CO., LTD. were strongly mixed with 100 parts of the toner base particle 20 by Q-mixer from NIPPON COKE & ENGINEERING CO., LTD. to be fixed on the toner base particle 20 to obtain a [toner base particle 22]. One hundred (100) parts of the [toner base particle 22] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Comparative Example 3].

Comparative Example 4

Two hundred (200) parts of the "slurry liquid of toner 1" processed to have solid contents of 25% by mass and 30.0 parts of the [dispersion of zirconium compound A (5)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 23]. One hundred (100) parts of the [toner base particle 23] were mixed with 1.0 part of NX-90S from Nippon Aerosil Co., Ltd., 1.0 part of JMT-1501B from Tayca Corp. and 1.0 part of the HSP-160A from Fuso Chemical Co., Ltd. by a Henschel mixer, and passed through a sift having a mesh size of 25 μm to thereby obtain a [toner of Comparative Example 4].

Comparative Example 5

Two hundred (200) parts of the "slurry liquid of toner 1" processed to have solid contents of 25% by mass and 1.0 part of the [dispersion of zirconium compound A (1)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 24]. One hundred (100) parts of the [toner base particle 24] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Comparative Example 5].

Comparative Example 6

Two hundred (200) parts of the "slurry liquid of toner 1" processed to have solid contents of 25% by mass and 32.5 parts of the [dispersion of zirconium compound A (2)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 25]. One hundred (100) parts of the [toner base particle 25] were mixed with 1.0 part of NX-90S from Nippon Aerosil Co., Ltd., 1.0 part of JMT-150B from Tayca Corp. and 1.0 part of the HSP-160A from Fuso Chemical Co., Ltd. by a Henschel mixer, and passed through a sift having a mesh size of 25 μm to thereby obtain a [toner of Comparative Example 6].

Comparative Example 7

Two hundred (200) parts of the "slurry liquid of toner 1" processed to have solid contents of 25% by mass and 5.0 parts of the [dispersion of zirconium compound A (3)] were mixed. One (1)% by mass hydrochloric acid as an aggregating agent was gradually added to the mixture to have a pH of 2, and the zirconium compound A was aggregated on the toner 1. The resultant liquid was held for 1 hr at 50° C. to fix the zirconium compound A on the surface of the toner. The liquid was filtered and dried with an air-circulating drier at 45° C. for 48 hrs, and then was caused to pass through a sieve with a mesh size of 75 μm, to thereby obtain a [toner base particle 26]. One hundred (100) parts of the [toner base particle 26] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Comparative Example 7].

Comparative Example 8

Zero point twenty five (0.25) parts of Zn-salicylic acid derivative complex BONTRON E-84 from ORIENT CHEMICAL INDUSTRIES CO., LTD. were strongly mixed with 100 parts of the toner base particle 20 by Q-mixer from NIPPON COKE & ENGINEERING CO., LTD. to be fixed on the toner base particle 20 to obtain a [toner base particle 27]. One hundred (100) parts of the [toner base particle 27] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Comparative Example 8].

Comparative Example 9

One hundred (100) parts of the toner base particle 20 were added to 250 parts by weight of ion-exchanged water including sodium lauryl sulfate in an amount of 0.1% by weight while stirred, and the mixture was stirred for 10 min.

Ten (10) min later, whether the toner base particle 20 was completely wet with the aqueous solution was visually observed, and whether the particles were separately dispersed from each other was observed by an optical microscope as well.

The resultant dispersion was subjected to centrifugal sedimentation separation, supernatant removal, and re-dispersed with ion-exchanged water in an amount same as that of the removed supernatant. This was repeated three times to obtain a refined dispersion of the toner base particle 20.

Three point seventy five (3.75) parts of the [dispersion of zinc compound F] were added to the dispersion while stirred, and the resultant liquid was held at 50° C. for 10 min to fix the zinc compound F on the surface of the toner particle.

The liquid was filtered and dried with an air-circulating drier at 45° C. for 48 hrs, and then was caused to pass through a sieve with a mesh size of 75 μm, to thereby obtain a [toner base particle 28]. One hundred (100) parts of the [toner base particle 28] were mixed with 1.0 part of NX-90S from Nippon Aerosil Co., Ltd., 1.0 part of JMT-150IB from Tayca Corp. and 1.0 part of the HSP-160A from Fuso Chemical Co., Ltd. by a Henschel mixer, and passed through a sift having a mesh size of 25 μm to thereby obtain a [toner of Comparative Example 9].

The content of the metal complex or the salt of the aromatic carboxylic acid derivative, the particle diameter of the toner, and a ratio of the amorphous polyester resins in Examples 1 to 19 and Comparative Examples 1 to 9 are shown in Table 3. The results of image analysis of each of the toners, a number-average particle diameter of each of the metal complex or the salt of the aromatic carboxylic acid derivative, and a coverage thereof on each of the toner in Examples 1 to 19 and Comparative Examples 1 to 9 are shown in Table 4. In Table 3, the metal complex or the salt of the aromatic carboxylic acid derivative is simply written as metal compound in Table 3.

TABLE 3

| | Amount of Metal Compound [% by mass] | Content of Metal Compound Dispersion [part] | Particle Diameter of Toner [μm] | Ratio of Amorphous Polyester A1/A2/A3 |
|---|---|---|---|---|
| Example 1 | 1.3 | 6.3 | 5.5 | 100/0/0 |
| Example 2 | 5.0 | 25.0 | 5.5 | 100/0/0 |
| Example 3 | 1.0 | 5.0 | 5.5 | 100/0/0 |
| Example 4 | 2.0 | 10.0 | 5.5 | 100/0/0 |
| Example 5 | 1.6 | 7.9 | 7 | 100/0/0 |
| Example 6 | 2.0 | 10.0 | 5.5 | 100/0/0 |
| Example 7 | 1.7 | 8.7 | 5.5 | 100/0/0 |
| Example 8 | 1.8 | 9.1 | 5.5 | 100/0/0 |
| Example 9 | 1.8 | 9.1 | 5.5 | 100/0/0 |
| Example 10 | 1.9 | 9.3 | 5.5 | 100/0/0 |
| Example 11 | 4.0 | 20.0 | 5.5 | 100/0/0 |
| Example 12 | 2.0 | 10.0 | 5.5 | 33/0/67 |
| Example 13 | 2.0 | 10.0 | 5.5 | 25/75/0 |
| Example 14 | 2.0 | 10.0 | 5.5 | 20/0/80 |
| Example 15 | 2.0 | 10.0 | 5.5 | 20/80/0 |
| Example 16 | 2.5 | 12.5 | 5.5 | 100/0/0 |
| Example 17 | 4.5 | 22.5 | 5.5 | 100/0/0 |
| Example 18 | 5.6 | 28.1 | 5.5 | 100/0/0 |
| Example 19 | 5.0 | 279 (add to oil phase) + 10.0 (add while washing) | 5.5 | 100/0/0 |
| Comparative Example 1 | 0 | 0 | 5.5 | 100/0/0 |
| Comparative Example 2 | 5.0 | 477.7 | 5.5 | 100/0/0 |
| Comparative Example 3 | 0.44 | — | 5.5 | 100/0/0 |
| Comparative Example 4 | 6.0 | 30.0 | 5.5 | 100/0/0 |
| Comparative Example 5 | 0.2 | 1.0 | 5.5 | 100/0/0 |
| Comparative Example 6 | 6.5 | 32.5 | 5.5 | 100/0/0 |
| Comparative Example 7 | 1.0 | 5.0 | 5.5 | 100/0/0 |
| Comparative Example 8 | 0.25 | — | 5.5 | 100/0/0 |
| Comparative Example 9 | 0.75 | 37.5 | 5.5 | 100/0/0 |

TABLE 4

| | Particle Diameter [μm] | Coverage [%] |
|---|---|---|
| Example 1 | 0.25 | 18 |
| Example 2 | 0.99 | 19 |
| Example 3 | 0.39 | 10 |
| Example 4 | 0.39 | 21 |
| Example 5 | 0.19 | 19 |
| Example 6 | 0.39 | 20 |

TABLE 4-continued

| | Particle Diameter [μm] | Coverage [%] |
|---|---|---|
| Example 7 | 0.40 | 21 |
| Example 8 | 0.40 | 22 |
| Example 9 | 0.38 | 20 |
| Example 10 | 0.37 | 19 |
| Example 11 | 0.39 | 38 |
| Example 12 | 0.39 | 19 |
| Example 13 | 0.39 | 22 |
| Example 14 | 0.39 | 21 |
| Example 15 | 0.39 | 21 |
| Example 16 | 0.51 | 20 |
| Example 17 | 0.39 | 44 |
| Example 18 | 0.51 | 46 |
| Example 19 | 0.39 | 19 |
| Comparative Example 1 | 0 | 0 |
| Comparative Example 2 | 0.39 | 0.1 |
| Comparative Example 3 | 0 | 0 |
| Comparative Example 4 | 1.24 | 20 |
| Comparative Example 5 | 0.39 | 2 |
| Comparative Example 6 | 0.39 | 61 |
| Comparative Example 7 | 0.51 | 7 |
| Comparative Example 8 | 0.37 | 3 |
| Comparative Example 9 | 0.37 | 7 |

(Evaluation Result by Image Forming Apparatus)

The toners of Examples 1 to 19 and Comparative Examples 1 to 9 were filled in a digital full-color multifunctional printer MP C6003 from Ricoh Company, Ltd. to evaluate the followings. The evaluation results are shown in Table 5.

<Evaluation of Cold Offset Resistance>

A solid image having a size of 3 cm×15 cm was produced on a PPC paper 6000<70W>A4 T from Ricoh Company, Ltd. so as to have a toner adhering to the image in an amount of 0.85 mg/cm$^2$. The fixing temperature was decreased 1° C. by 1° C. from 160° C. and an image was produced every time.

A temperature at which cold offset started occurring was measured.

<Evaluation of Anti-Blocking of Ejected Papers>

Two hundred (200) pieces of a solid image having a size of 3 cm×15 cm were continuously produced on each one side of PPC papers 6000<70W>A4 T from Ricoh Company, Ltd. so as to have a toner adhering to each of the images in an amount of 0.85 mg/cm$^2$. The fixing temperature was controlled to be cold offset temperature+20° C. on average. The 200 produced images were left for 1 hr while stacked, and sticking between images was evaluated.

[Criteria of Anti-Blocking Evaluation]

Excellent: No sticking

Good: Slightly sticking, but the papers were easily separated from each other and the image had no problem in quality Average: Slightly sticking, and slight noises were made when the papers were separated from each other, but the image had no problem in quality Fair: Slightly sticking, and the image deteriorated in glossiness when the papers were separated from each other Poor: The papers stuck to each other, the image and the papers were damaged when <Evaluation of Image Preservability>

A solid image having a size of 3 cm×15 cm was produced on one side of a PPC paper 6000<70W>A4 T from Ricoh Company, Ltd. so as to have a toner adhering to the image in an amount of 0.85 mg/cm$^2$. The fixing temperature was controlled to be cold offset temperature+20° C. on average. The resultant images were contacted to each other, a weight equivalent to 8 kPa was placed thereon, and left for 1 week under an environment of 60° C. 50% RH. Then, they were peeled off from each other to observe.

(Criteria of Image Preservability Evaluation)

Excellent: The papers did not stick to each other at all, and there were no missing images and no image transfer Good: The papers slightly stuck to each other (slight made noises) when peeled off from each other, but they were easily separated from each other without any missing image and image transfer.

Fair: The papers stuck to each other, and there were missing images and image transfer Poor: The papers stuck to each other, and there were serious missing images and the papers broke

TABLE 5

| | Cold Offset Occurring Temperature [° C.] | Anti-Blocking of Ejected Papers | Image Preservability |
|---|---|---|---|
| Example 1 | 111 | Excellent | Excellent |
| Example 2 | 130 | Good | Good |
| Example 3 | 110 | Excellent | Excellent |
| Example 4 | 114 | Excellent | Excellent |
| Example 5 | 113 | Excellent | Excellent |
| Example 6 | 126 | Excellent | Excellent |
| Example 7 | 114 | Excellent | Excellent |
| Example 8 | 115 | Excellent | Excellent |
| Example 9 | 116 | Excellent | Excellent |
| Example 10 | 114 | Good | Good |
| Example 11 | 125 | Excellent | Excellent |
| Example 12 | 109 | Excellent | Excellent |
| Example 13 | 120 | Excellent | Excellent |
| Example 14 | 109 | Good | Good |
| Example 15 | 130 | Excellent | Excellent |
| Example 16 | 118 | Excellent | Good |
| Example 17 | 128 | Excellent | Excellent |
| Example 18 | 130 | Excellent | Excellent |
| Example 19 | 118 | Excellent | Excellent |
| Comparative Example 1 | 105 | Poor | Fair |
| Comparative Example 2 | 110 | Poor | Fair |
| Comparative Example 3 | 107 | Fair | Average |
| Comparative Example 4 | 120 | Poor | Average |
| Comparative Example 5 | 106 | Poor | Average |
| Comparative Example 6 | 142 | Excellent | Excellent |
| Comparative Example 7 | 111 | Fair | Average |
| Comparative Example 8 | 106 | Poor | Fair |
| Comparative Example 9 | 111 | Poor | Average |

The image forming apparatus of the present invention was proved to be capable of fixing images at low temperature to save power consumption and producing images having good anti-blocking and preservability.

Having now fully described the invention, it will be apparent to one of ordinary skill in the art that many changes and modifications can be made thereto without departing from the spirit and scope of the invention as set forth therein.

What is claimed is:

1. A toner, comprising:

a binder resin; and a metal complex or a salt of an aromatic carboxylic acid derivative, wherein at least a part of the metal complex or the salt of an aromatic carboxylic acid derivative is present on a surface of the toner, and wherein a coverage of the metal complex or the salt of an aromatic carboxylic acid derivative over the surface of the toner is from 10% to 50%.

2. The toner of claim 1, wherein the metal complex or the salt of the aromatic carboxylic acid derivative is a metal complex or salt of a salicylic acid derivative having the following formula (1):

(1)

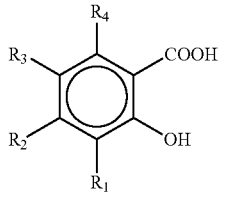

wherein $R^1$ to $R^4$ independently represent a member selected from the group consisting of a hydrogen atom, a linear or branched alkyl group having 1 to 12 carbon atoms, a linear or branched alkenyl group having 2 to 12 carbon atoms, —OH, —$NH_2$, —$NH(CH_3)$, —$N(CH_3)_2$, —$OCH_3$, —$O(C_2H_5)$, —COOH and —$CONH_2$.

3. The toner of claim 1, wherein the metal complex or the salt of the salicylic acid derivative is a metal complex or a salt of a ditertiary butyl salicylic acid.

4. The toner of claim 1, wherein the metal forming the metal complex or the salt is $Zr^{4+}$.

5. The toner of claim 1, wherein the metal complex or the salt of an aromatic carboxylic acid derivative has a number-average particle diameter of from 0.2 μm to 0.5 μm.

6. The toner of claim 1, wherein a metal forming the metal complex or the salt is a member selected from the group consisting of $Al^{3+}$, $Fe^{3+}$ and $Zr^{4+}$.

7. The toner of claim 1, wherein the toner has an acid value of from 10 mgKOH/g to 50 mgKOH/g.

8. An image forming method, comprising:

forming an electrostatic latent image on an electrostatic latent image bearer; and developing the electrostatic latent image with the toner according to claim 1 to form a visible image.

9. A toner housing unit housing the toner according to claim 1.

10. An image forming apparatus, comprising:

an electrostatic latent image bearer;

an electrostatic latent image forming unit to form an electrostatic latent image on the electrostatic latent image bearer; and a developing unit to develop the electrostatic latent image with the toner according to claim 1 to form a visible image.

11. The toner of claim 2, wherein the metal forming the metal complex or the salt is $Zr^{4+}$.

12. The toner of claim 2, wherein the metal complex or the salt of an aromatic carboxylic acid derivative has a number-average particle diameter of from 0.2 μm to 0.5 μm.

13. The toner of claim 2, wherein a metal forming the metal complex or the salt is a member selected from the group consisting of $Al^{3+}$, $Fe^{3+}$ and $Zr^{4+}$.

14. The toner of claim 2, wherein the toner has an acid value of from 10 mgKOH/g to 50 mgKOH/g.

15. The toner of claim 1, wherein the metal complex or the salt of the aromatic carboxylic acid derivative is a metal complex or salt of a salicylic acid derivative having the following formula (2):

(2)

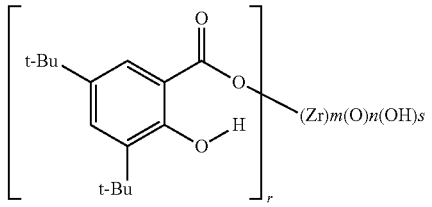

wherein m represents an integer of from 1 to 20; n represents 0 or an integer of from 1 to 20; s represents 0 or an integer of from 1 to 20; r represents an integer of from 1 to 20; and t-Bu represents a tertiary butyl group.

16. The toner of claim 1, wherein the toner comprises the particles of the metal complex or the salt of the aromatic carboxylic acid derivative in an amount of from 0.4% to 6% by mass.

17. The toner of claim 2, wherein the toner comprises the particles of the metal complex or the salt of the aromatic carboxylic acid derivative in an amount of from 0.4% to 6% by mass.

18. The toner of claim 3, wherein the toner comprises the particles of the metal complex or the salt of the aromatic carboxylic add derivative in an amount of from 0.4% to 6% by mass.

19. The toner of claim 11, wherein the toner comprises the particles of the metal complex or the salt of the aromatic carboxylic acid derivative in an amount of from 0.4% to 6% by mass.

20. The toner of claim 1, wherein a metal forming the metal complex or the salt is a member selected from the group consisting of $Zn^{2+}$, $Al^{3+}$, $Fe^{4+}$ and $Zr^{4+}$.

21. The toner of claim 1, wherein the metal complex or the salt of an aromatic carboxylic acid derivative has a number-average particle diameter of from 0.2 μm to 1.0 μm.

22. The toner of claim 1, wherein the binder resin comprises a polyester resin.

23. The toner of claim 21, wherein the binder resin comprises a polyester resin.

* * * * *